US006174210B1

(12) United States Patent
Spade et al.

(10) Patent No.: US 6,174,210 B1
(45) Date of Patent: Jan. 16, 2001

(54) WATERCRAFT CONTROL MECHANISM

(75) Inventors: Sam Spade, Palm Bay, FL (US); Normand Beauregard, Valcourt; Richard Simard, St-Charles-de-Drummond, both of (CA)

(73) Assignee: Bombardier Inc., Quebec (CA)

( * ) Notice: Under 35 U.S.C. 154(b), the term of this patent shall be extended for 0 days.

(21) Appl. No.: 09/088,854

(22) Filed: Jun. 2, 1998

(51) Int. Cl.[7] ..... B63H 11/11
(52) U.S. Cl. ..... 440/41; 114/284
(58) Field of Search ..... 440/41, 42, 47; 114/284, 285, 286, 287

(56) References Cited

U.S. PATENT DOCUMENTS

| | | | | |
|---|---|---|---|---|
| 3,272,171 | | 9/1966 | Korcak | 114/145 |
| 3,565,030 | * | 2/1971 | Curtis | 114/285 |
| 3,628,486 | * | 12/1971 | Bennett | 114/285 |
| 3,942,461 | | 3/1976 | Smith | 114/144 C |
| 4,149,469 | | 4/1979 | Bigler | 104/73 |
| 4,175,721 | | 11/1979 | Lempa, Jr. | 244/83 |
| 4,323,027 | | 4/1982 | Schermerhorn | 114/285 |
| 4,352,666 | | 10/1982 | McGowan | 440/53 |
| 4,355,985 | | 10/1982 | Borst et al. | 440/51 |
| 4,583,030 | | 4/1986 | Nixon | 318/580 |
| 4,615,290 | | 10/1986 | Hall | 114/150 |
| 4,632,049 | | 12/1986 | Hall et al. | 114/150 |
| 4,749,926 | | 6/1988 | Ontolchik | 318/588 |
| 4,759,732 | | 7/1988 | Atsumi | 440/1 |
| 4,762,079 | | 8/1988 | Taleuchi et al. | 114/152 |
| 4,787,867 | | 11/1988 | Takeuchi et al. | 440/1 |
| 4,854,259 | | 8/1989 | Cluett | 114/285 |
| 4,908,766 | | 3/1990 | Takeuchi | 364/448 |
| 4,961,396 | | 10/1990 | Sasagawa | 114/285 |
| 4,964,821 | | 10/1990 | Tafoya | 440/38 |
| 4,967,682 | | 11/1990 | O'Donnell | 114/286 |
| 5,062,815 | | 11/1991 | Kobayashi | 440/41 |
| 5,085,603 | | 2/1992 | Haluzak | 440/51 |
| 5,092,260 | | 3/1992 | Mardikian | 114/285 |
| 5,154,650 | | 10/1992 | Nakase | 440/41 |
| 5,193,478 | | 3/1993 | Mardikian | 114/286 |
| 5,199,913 | * | 4/1993 | Toyohara et al. | 440/47 |
| 5,263,462 | | 11/1993 | Davis | 114/286 |
| 5,474,007 | | 12/1995 | Kobayashi | 440/42 |
| 5,494,464 | | 2/1996 | Kobayashi et al. | 440/41 |
| 5,607,332 | | 3/1997 | Kobayashi et al. | 440/41 |

OTHER PUBLICATIONS

Smith, Steve. *Hot Water*, vol. 5, No. 4, "Them's the Brakes," pp. 8, 51.

* cited by examiner

*Primary Examiner*—Jesus D. Sotelo
(74) *Attorney, Agent, or Firm*—Pillsbury Madison & Sutro LLP

(57) ABSTRACT

A control mechanism for a watercraft is described herein, said control mechanism comprising a steerable propulsion source, a steering controller for controlling said steerable propulsion source, a linking member connected to said steerable propulsion source, and at least one tab connected to said linking member, said at least one tab moveable between an inoperative position and an operative position whereby said at least one tab can be angled such that, in the operative position and when said watercraft is traveling upright in water in a substantially forward direction, a volume of water impinges on a top surface of said at least one tab thereby creating a downward and rearward force on said watercraft.

101 Claims, 14 Drawing Sheets

Fig.20
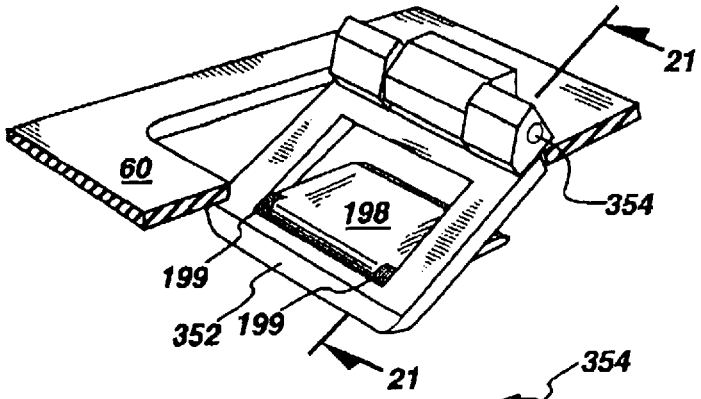
Fig.21
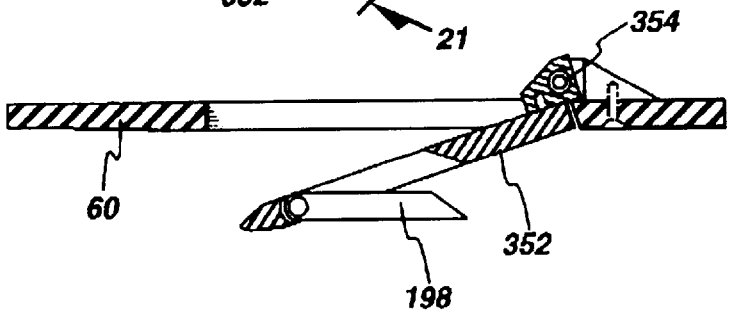
Fig.22
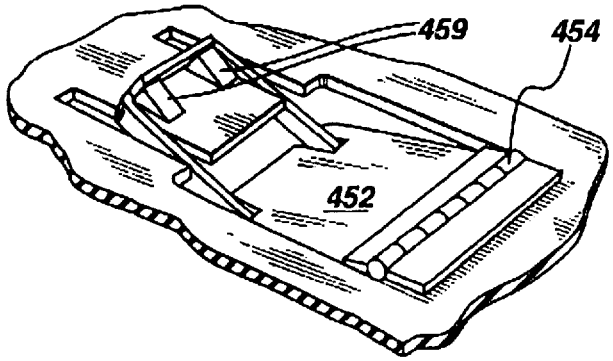
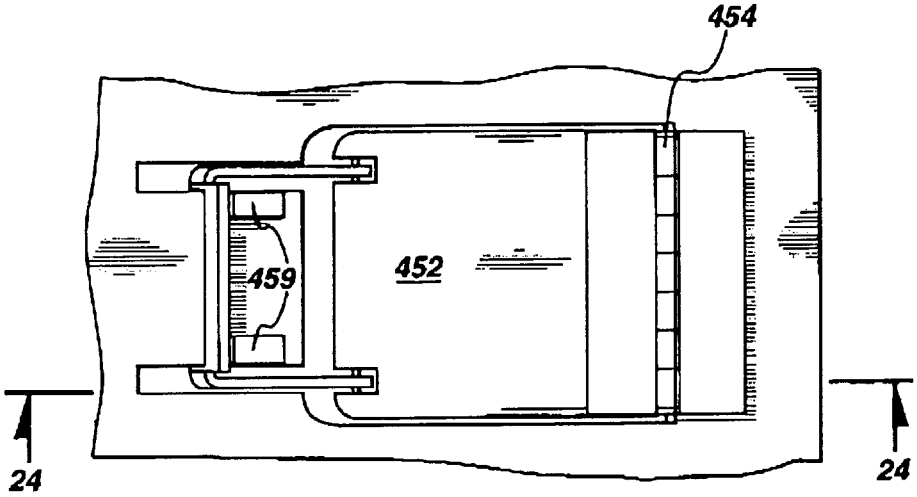
Fig.23

Fig.24
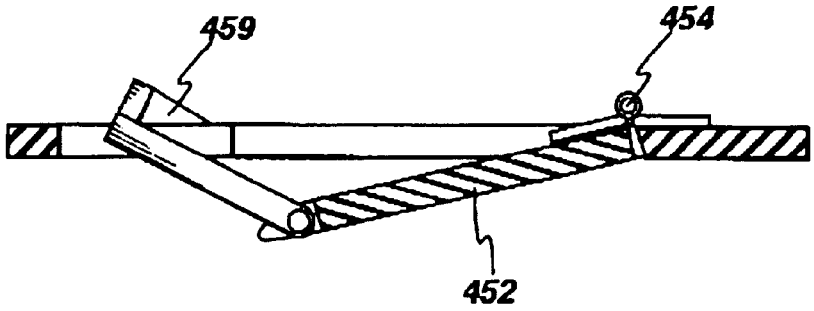
Fig.25
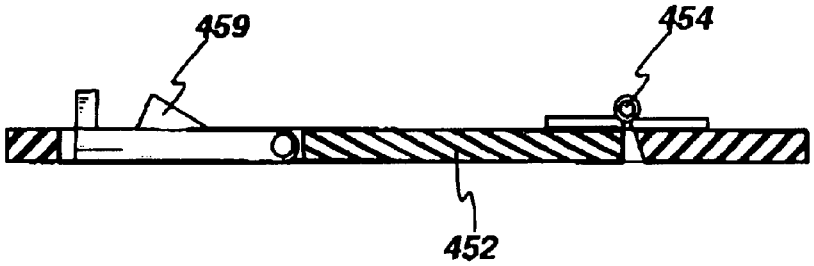
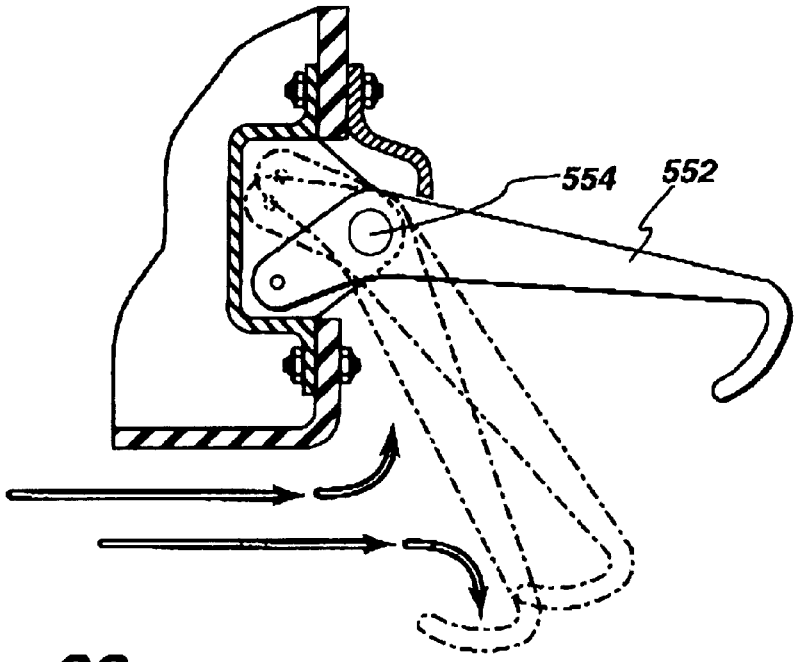
Fig.26

WATERCRAFT CONTROL MECHANISM

FIELD OF THE INVENTION

The present invention pertains to a watercraft control mechanism and, more particularly, to a watercraft control mechanism that provides enhanced, integrated steering, decelerating and trimming.

BACKGROUND OF THE INVENTION

In recent years, the demands of racers and recreational users alike for greater performance and maneuverability have driven the designers of personal watercraft to reconsider the control mechanisms traditionally used for steering, decelerating and trimming. In general, steering, decelerating and trimming can be achieved in a variety of manners, either independently of one another or synergistically.

Essentially, the steering of a boat can be achieved by either turning the source of propulsion, such as an outboard motor or a jet-boat nozzle, or by actuating the boat's control surfaces. These control surfaces can be substantially vertical such as the common rudder on a stern drive or they can be substantially horizontal, such as flaps and tabs. Examples of steering mechanisms involving vertical fins or rudders are found in U.S. Pat. Nos. 4,615,290 and 4,632,049, issued to Hall et al., and in U.S. Pat. No. 4,352,666, issued to McGowan. Examples of steering mechanisms involving horizontal tabs or flaps are found in Mardikian's U.S. Pat. No. 5,193,478.

Decelerating can generally be accomplished in one of three ways: by either reversing thrust, by redirecting the thrust toward the bow of the watercraft, or by creating drag by introducing a control surface substantially perpendicular to the watercraft's direction of travel. Decelerating by reversing thrust is perhaps the most common technique, simply requiring the propellor to turn backwards. The main problem associated with this technique is that decelerating is slow due to the time lag required to stop and then to reverse the propellor.

Redirecting the thrust toward the bow is a braking technique currently employed by numerous personal watercraft. Examples of thrust-reversing buckets or reverse gates have been disclosed by Kobayashi et al. in U.S. Pat. Nos. 5,062,815, 5,474,007, 5,607,332, 5,494,464 as well as by Nakase in U.S. Pat. No. 5,154,650. Although these thrust-reversing buckets direct the water jet backwards, they also have a propensity to direct the water jet downwards. This downward propulsion lifts the stern of the watercraft and causes the bow to dive. The sudden plunging of the bow not only makes the watercraft susceptible to flooding and instability but also makes it difficult for the rider to remain comfortably seated and firmly in control of the steering column.

Mardikian discloses in U.S. Pat. No. 5,092,260 a brake and control mechanism for personal watercraft involving a hinged, retractable flap mounted on each side of the hull capable of being angled into the water to slow the boat. However, when the actuator is extended, the flap pivots such that the trailing edge is lower than the leading edge, thereby creating an undesirable elevating force at the stern.

Trimming or stabilizing of a watercraft is normally achieved by adjusting the angle of the tabs mounted aft on the hull. Trim-tabs are used to alter the running attitude of the watercraft, to compensate for changes in weight distribution and to provide the hull with a larger surface for planing. Examples of trim-tab systems for watercraft are disclosed in Cluett's U.S. Pat. No. 4,854,259, Sasawaga's U.S. Pat. No. 4,961,396 and Schermerhorn's U.S. Pat. No. 4,323,027. Typically, these trim-tabs systems are actuated by electronic feedback control systems capable of sensing the boat's pitch and roll as well as wave conditions and then making appropriate adjustments to the trim-tabs to stabilize the boat. Examples of trim-tab control systems are found in Davis' U.S. Pat. No. 5,263,432, Ontolchik's U.S. Pat. No. 4,749,926, Atsumi's U.S. Pat. No. 4,759,732 and Takeuchi's U.S. Pat. No. 4,908,766. The foregoing trim-tab mechanisms deflect the water downward and thus elevate the stern. The stabilizing system for watercraft disclosed by O'Donnell in U.S. Pat. No. 4,967,682 attempts to address this problem by introducing a twin-tab mechanism capable of deflecting the flow of water under the hull either upwards or downwards to either elevate or lower the stern of the watercraft. O'Donnell's twin-tab mechanism, however, is designed expressly for stabilizing a watercraft and not for braking.

Steering, braking and trimming can also be performed synergistically. Mardikian's U.S. Pat. No. 5,193,478 discloses an adjustable brake and control flaps for steering, braking and trimming a watercraft. The flaps, located at the stern, in their fully declined position act as powerful brakes for the boat. Differential declination of the flaps results in trimming and steering of the boat. The flaps provide steering, braking and trimming in a manner analogous to the flaps and ailerons of an aircraft. During braking, however, the downward sweep of the tabs causes the stern to rise and the bow of the personal watercraft to plunge, often creating the potential for flooding and instability. Not only is the plunging of the bow uncomfortable for the rider but the watercraft is more difficult to control during hard braking maneuvers.

Finally, Korcak's U.S. Pat. No. 3,272,171 discloses a control and steering device for watercraft featuring a pair of vanes that can be pivotally opened below the hull of the watercraft to which they are mounted. The vanes are hinged at the ends closest to the stern and open toward the bow of the watercraft. As water is scooped by the opening vanes, the force of the water impinging on the vanes forces the vanes to open even more. In order to prevent the vanes from being violently flung open against the underside of the watercraft, a ducting system has been incorporated into the vanes to channel scooped water through the rear of the vanes to cushion the hull from the impact of the rear of the vanes. One of the shortcomings of this control mechanism, however, is that the scooping action of the vanes induces a great deal of turbulence on the underside of the watercraft especially when braking at high speeds. Secondly, the amount of water that is channeled through the ducts of the vanes is minimal and thus braking might, in some conditions, be too harsh. Thirdly, the presence of the vanes (even when full retracted) and their associated attachment bases on the underside of the watercraft create drag at high speeds. Fourthly, the vanes are not integrated with a main steering mechanism (such as a rudder or steerable nozzle) to provide better cornering. Fifthly, the vanes may scoop up seaweed, flotsam or other objects floating in the water that may prevent the vanes from closing or may clog the ducts in the vanes. Finally, to close the vanes when they are scooping water requires large gears whose weight causes the rear of the watercraft to sag.

Thus, there is a need for an improved watercraft control mechanism capable of steering and/or decelerating and/or trimming a watercraft without causing the stern to elevate and the bow to plunge.

OBJECT AND STATEMENT OF THE INVENTION

It is thus the object of the present invention to provide an apparatus or mechanism for steering and/or decelerating and/or trimming a watercraft without causing the stern of the watercraft to elevate and the bow to plunge, therefore optimizing stability, control and comfort.

It is another object of the present invention to provide an apparatus to steer a watercraft when the throttle is cut and no steerable thrust is available.

It is another object of the present invention to provide an apparatus for steering and/or trimming and/or decelerating a watercraft that can be stowed or retracted to minimize hydrodynamic drag at high speeds.

It is another object of the present invention to provide an apparatus for steering, trimming and decelerating a watercraft that does not become clogged or jammed by seaweed or flotsam or foreign objects floating in the water.

It is another object of the present invention to provide an apparatus for decelerating a watercraft in a smooth and stable fashion when the watercraft is travelling at high speeds.

As embodied and broadly described herein, the invention provides a control mechanism for a watercraft, said mechanism comprising a steerable propulsion source, a steering controller for controlling said steerable propulsion source, a linking member connected to said steerable propulsion source and at least one tab connected to said linking member, said at least one tab moveable between an inoperative position and an operative position whereby said at least one tab can be angled such that, in the operative position and when said watercraft is traveling upright in water in a substantially forward direction, a volume of water impinges on a top surface of said at least one tab thereby creating a downward and rearward force on said watercraft.

Such a control mechanism provides a very efficient way of steering and/or decelerating and/or trimming a watercraft and simultaneously acting to maintain or force the stern of the watercraft downwardly. The maneuverability and stability of the watercraft is thus enhanced. The watercraft is able to corner more sharply and to decelerate more rapidly than before. This arrangement also allows the watercraft to be steered when the throttle is cut. The tabs can also function as trimming devices for stabilizing the watercraft and/or for augmenting the planing surface of the hull of the watercraft.

Advantageously, the tab is translationally displaceable between the inoperative position and the operative position.

Such an arrangement is very cost-effective, simple and reliable.

In an advantageous variant, the tab is pivotally displaceable between the inoperative position and the operative position.

This arrangement provides a plurality of angular positions for improving steering and trimming capabilities.

In another advantageous variant, the tab has a variable surface.

This provides a single and efficient means for reducing the force acting on a tab at high speeds to enhance ride comfort to provide more controlled, stable decelerations.

Advantageously, the variable surface includes a section that is moveable with respect to said at least one tab to allow a volume of water to pass through said at least one tab.

Such an arrangement avoids overpressure when the watercraft travels at high speeds. By alleviating the force of the water impinging on the tab, the stresses in the tab-actuating mechanism can thus be reduced. This means that components of the tab-actuating mechanism can be made smaller and lighter than would otherwise be necessary to support the forces associated with a tab without such a moveable section.

Advantageously, the at least one tab is hooked.

This provides a cost-effective and easily manufactured tab that occupies little space and can be used to create a drag force on the watercraft.

Advantageously, the watercraft further comprises a decelerating actuation mechanism for displacing at least one tab from the inoperative position to the operative position for creating a downward and rearward force on said watercraft.

Such a tab is preferably centrally disposed. An arrangement with a plurality of symmetrical tabs is also possible. The tab(s) in the operative position create(s) a drag force acting in a direction substantially opposite to the traveling direction of the boat when the latter is traveling in a substantially forward direction. The tab(s) will decelerate the boat if the drag force exerted by the tab(s) exceeds the propulsive force.

As embodied and broadly described herein, the invention also provides a control mechanism for a watercraft, said mechanism comprising a decelerating actuation mechanism and at least one tab capable of being activated by said decelerating actuation mechanism, said at least one tab moveable between an inoperative position and an operative position whereby said at least one tab can be angled such that, in the operative position and when said watercraft is traveling upright in water in a substantially forward direction, a volume of water impinges on a top surface of said at least one tab thereby creating a downward and rearward force on said watercraft.

Such a tab is preferably centrally disposed. An arrangement with a plurality of symmetrical tabs is also possible. The tab(s) in the operative position create(s) a drag force acting in a direction substantially opposite to the traveling direction of the boat when the latter is travelling in a substantially forward direction. The tab(s) will decelerate the boat if the drag force exerted by the tab(s) exceeds the propulsive force.

As embodied and broadly described herein, the invention also provides a control mechanism for a watercraft, said mechanism comprising a steerable propulsion source, a steering controller for controlling said steerable propulsion source, a linking member connected to said steerable propulsion source, and at least one tab connected to said linking member, said tab moveable between an inoperative position and a plurality of operative positions whereby said at least one tab can be angled such that, in the operative positions and when said watercraft is traveling upright in water in a substantially forward direction, a volume of water impinges on a top surface of said at least one tab thereby creating a downward and rearward force on said watercraft.

With a plurality of operative positions, the user of such a watercraft control mechanism would be able to steer and/or decelerate and/or trim the watercraft to varying degrees thereby affording the driver a much greater degree of control.

As embodied and broadly described herein, the invention also provides a control mechanism for a watercraft, said mechanism comprising at least one tab provided with a variable surface.

Such an arrangement avoids overpressure when the watercraft travels at high speeds. By alleviating the force of the water impinging on the tab, the stresses in the tab-actuating mechanism can thus be reduced. This means that components of the tab-actuating mechanism can be made smaller and lighter than would otherwise be necessary to support the forces associated with a tab without such a moveable section.

As embodied and broadly described herein, this invention also provides a control mechanism for a watercraft, said control mechanism comprising at least two tabs each having a leading edge, a trailing edge and a pivoting point, and an actuator pivotally connected to said at least two tabs, said actuator capable of pivoting said at least two tabs about said pivoting point, said at least two tabs moveable between an inoperative position and an operative position whereby said at least two tabs can be angled such that, in the operative position and when said watercraft is traveling upright in water in a substantially forward direction, a volume of water impinges on a top surface of said at least two tabs thereby creating a downward and rearward force on said watercraft.

Such an arrangement provides advantageous steering and/or decelerating and/or trimming effects. An actuator activates the tab. This actuator is advantageously connected to said tab at a point distant from the pivoting axis. This provides a better force ratio and an enhanced efficiency.

Advantageously, each said tab can be actuated either asymmetrically, to produce an asymmetrical force for steering said watercraft, or symmetrically, to produce a symmetrical force in a direction substantially opposite to the direction of travel of said watercraft.

The control mechanism preferably further comprises a steerable propulsion source linked to said actuators whereby turning of said steerable propulsion source actuates at least one of said tabs.

The control mechanism preferably further comprises resiliently-biased flaps, said flaps having resilient members such that at high speeds a momentum of water impinging on said flaps forces open said flaps when said momentum exceeds a force generated by said resilient member.

As embodied and broadly described herein, the invention also provides a control mechanism kit for a watercraft, said kit comprising a linking member connectable to a steerable propulsion source and at least one tab connectable to said linking member, said at least one tab moveable between an inoperative position and an operative position whereby said at least one tab can be angled such that, in the operative position and when said watercraft is traveling upright in water in a substantially forward direction, a volume of water impinges on a top surface of said at least one tab thereby creating a downward and rearward force on said watercraft.

Such a kit may be retrofitted on an existing watercraft. Linking members would be attached to a modified or existing steerable propulsion source. Tabs would be fitted under the hull or on the ride plate. Such a retrofit kit would be useful to any owner of a personal watercraft who wishes to improve the performance and control of his or her watercraft. Owners of personal watercraft may thus benefit from the present invention at low cost.

As embodied and broadly described herein, the invention also provides a watercraft control mechanism comprising a steerable propulsion source, a starboard actuating linkage connected to said steerable propulsion source, a port actuating linkage connected to said steerable propulsion source, a starboard tab connected to said starboard actuating linkage, a port tab connected to said port actuating linkage, a ride plate to which said starboard tab and said port tab are hingedly connected whereby turning of the steerable propulsion source to starboard causes said starboard tab to pivot below said ride plate thereby drag-steering to starboard and whereby turning of the steerable propulsion source to port causes said port tab to pivot below said ride plate thereby drag-steering to port, and a deceleration actuation linkage capable of causing said starboard tab and said port tab to pivot symmetrically below said ride plate thereby creating a force opposite a direction of travel of the watercraft.

Other objects and features of the invention will become apparent by reference to the following description and drawings.

BRIEF DESCRIPTION OF THE DRAWINGS

A detailed description of the preferred embodiments of the present invention is provided hereinbelow with reference to the following drawings in which:

FIG. 20 is a perspective view of a variant of the tab having a spring-loaded flap of FIG. 14;

FIG. 21 is a side elevational view of the tab of FIG. 20;

FIG. 22 is a perspective view of another variant of the tab of FIG. 14;

FIG. 23 is a top plan view of the tab of FIG. 22;

FIG. 24 is a cross-sectional view of the tab of FIG. 23 taken along line 23—23 in its open position;

FIG. 25 is a cross-sectional view of the tab of FIG. 23 taken along line 23—23 in its closed position;

FIG. 26 is a side elevational view of a hooked tab capable of exerting a downward force on the stern of a watercraft when in contact with the water;

Figure 2:
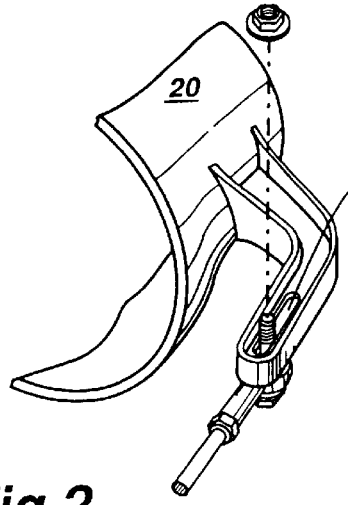
FIG. 2 is a perspective view of a variant nozzle arm of the watercraft control mechanism of FIG. 1 wherein the nozzle arm is provided with a slot therein.

In the drawings, the preferred embodiments of the invention are illustrated by way of example. It is to be expressly understood that the description and drawings are only for purposes of illustration and to facilitate understanding, and are not intended to be a definition of the limits of the invention.

DETAILED DESCRIPTION OF PREFERRED EMBODIMENTS

Figure 1:
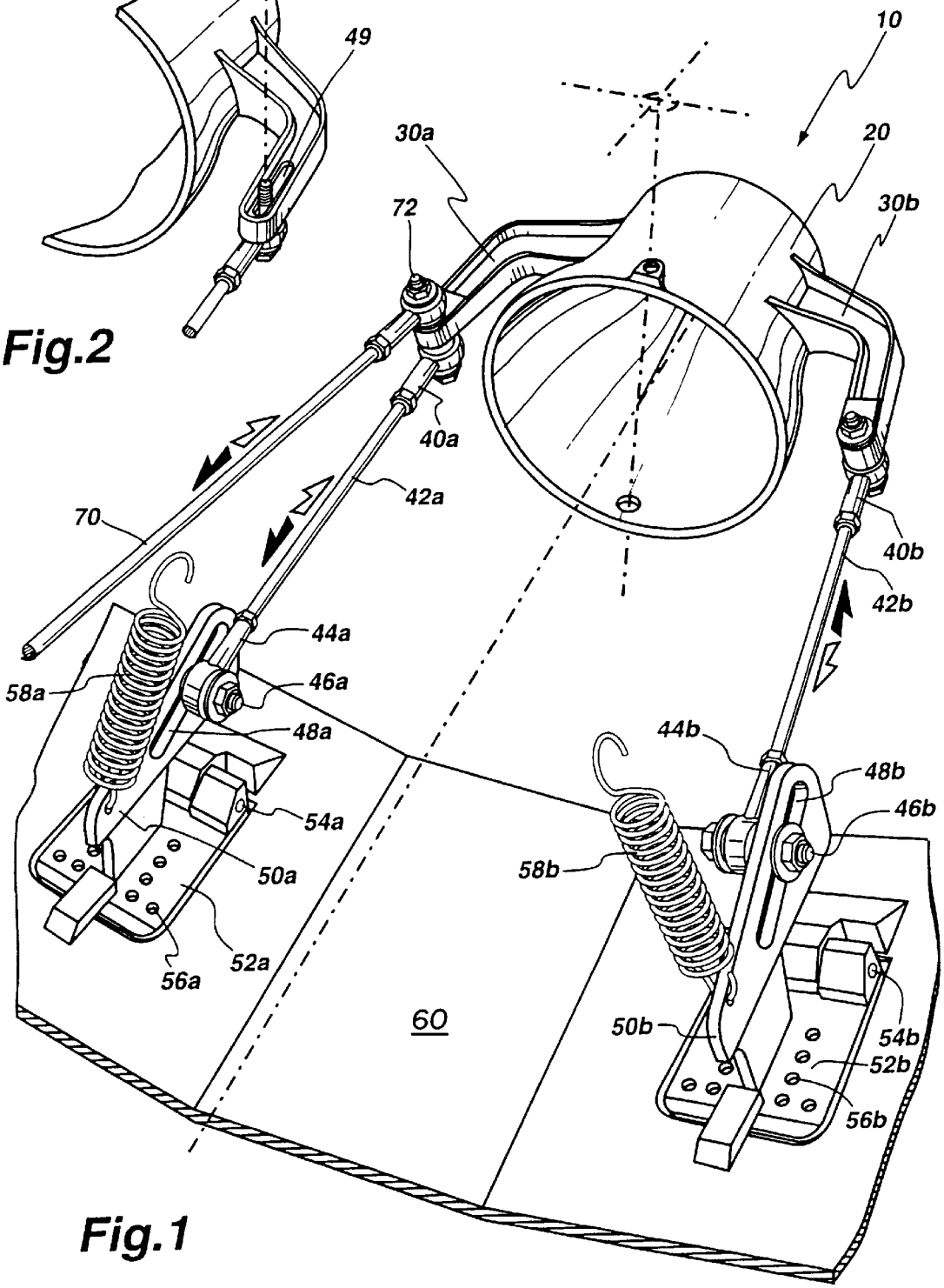
FIG. 1 is a perspective view of a watercraft control mechanism.

Referring to FIG. 1, a watercraft control mechanism 10 comprises a steerable nozzle 20 located at the stern of the watercraft. Attached to the steerable nozzle 20 is an L-shaped starboard nozzle arm 30*a* and an L-shaped port nozzle arm 30*b*. A spherical rod-end bearing 40*a* connects the starboard nozzle arm 30*a* to a starboard rod 42*a*. Symmetrically, a spherical rod-end bearing 40*b* connects the port nozzle arm 30*b* to a port rod 42*b*. The starboard rod 42*a* is connected to a reactive spherical rod-end bearing 44*a* while the port rod 42*b* is also connected to a reactive spherical rod-end bearing 44*b*. The reactive spherical rod-end bearings 44*a* and 44*b* are fastened to a starboard slider 46*a* and to a port slider 46*b*. The starboard slider 46*a* is constrained to translate within a starboard slot 48*a* which is machined from a starboard tab bracket 50*a*. Similarly, the port slider 46*b* is constrained to translate within a port slot 48*b* which is machined from a port tab bracket 50*b*. The starboard tab bracket 50*a* is attached to a starboard tab 52*a*. The starboard tab 52*a* is disposed with a plurality of holes 56*a* and is connected to a ride plate 60 by a hinge 54*a*. Similarly, the port tab bracket 50*b* is fixed to a port tab 52*b*. The tabs 52*a* and 52*b* are disposed with a plurality of holes 56*a* and 56*b* to dissipate the pressure gradient that might arise at high speeds (due to the Bernoulli effect) between the top side of the tab and the underside. The port tab 52*b* is also connected to the ride plate 60 by a hinge 54*b*. Springs 58*a* and 58*b* are connected to the top sides of the starboard tab bracket 50*a* and the port tab bracket 50*b*, respectively. A push-pull steering cable 70 is fixed to the starboard nozzle arm 30*a* at a steering joint 72.

Alternatively, as shown in FIG. 2, the starboard nozzle arm 30*a* and the port nozzle arm 30*b* may have a slot 49. The purpose of the slots is to create non-proportional actuation of the tabs 52*a* and 52*b*. It should be apparent to one skilled in the art that the push-pull steering cable could have been equivalently mounted on the port nozzle arm or on a separate steering arm rigidly connected to the steerable nozzle 20. Furthermore, it should also be apparent to one skilled in the art that two pull-only cables mounted to both the starboard nozzle arm 30*a* and the port nozzle arm 30*b* would achieve the same objective. Pneumatic or hydraulic actuators, solenoids or mechanical linkages could function in a manner equivalent to the push-pull cable illustrated in FIG. 1.

To operate the watercraft control mechanism 10, the driver simply actuates the push-pull steering cable 70 which causes the steerable nozzle 20 to turn. As the steerable nozzle 20 turns, the starboard slider 46*a* and the port slider 46*b* translate in opposite directions within the starboard slot 48*a* and the port slot 48*b*, respectively. To turn to starboard, for example, the push-pull steering cable 70 is pulled toward the bow, causing the steerable nozzle 20 to deflect towards starboard, creating a primary steering effect. As the steerable nozzle 20 turns to starboard, the starboard nozzle arm 30*a* exerts a force on the starboard rod 42*a* via the spherical rod-end bearing 40*a* which causes the reactive spherical rod-end bearing 44*a* and the starboard slider 46*a* to translate within the starboard slot 48*a*. When the starboard slider 46*a* contacts the front-lower end of the starboard slot 48*a*, the starboard slider 46*a* then exerts a force on the starboard tab bracket 50*a*. The force exerted on the starboard tab bracket 50*a* causes the starboard tab 52*a* to pivot about the hinge 54*a* and to decline below the ride plate 60. The declination of the starboard tab 52*a* induces a drag on the starboard side which creates a secondary steering effect.

The summation of the primary steering effect due to the turning of the steerable nozzle 20 and the secondary steering effect due to the tab drag produces steering superior to what could be attained with the nozzle alone. When the steerable nozzle 20 is returned towards its neutral, centered position, the starboard slider 46*a* stops exerting a downward force on the starboard tab bracket 50*a* and the starboard tab 52*a*, water pressure returns the starboard tab 52*a* to its neutral position with the help of the spring 58*a*. A decelerator cable (not shown in FIG. 1) can be used to simultaneously actuate the tabs 52*a* and 52*b*, creating a balanced drag force underneath the ride plate 60.

The techniques required for fabrication of the watercraft control mechanism 10 in accordance with the invention and as shown in FIG. 1 would be well-known to a person skilled in the art. Materials appropriate for the tabs and mechanical linkages would be aluminum, stainless steel, titanium or any alloy that is non-corrosive in sea water. The steerable nozzle, due to its complex curvatures, would best be molded from a high-strength plastic fiber-reinforced polymer or equivalent.

Figure 5:
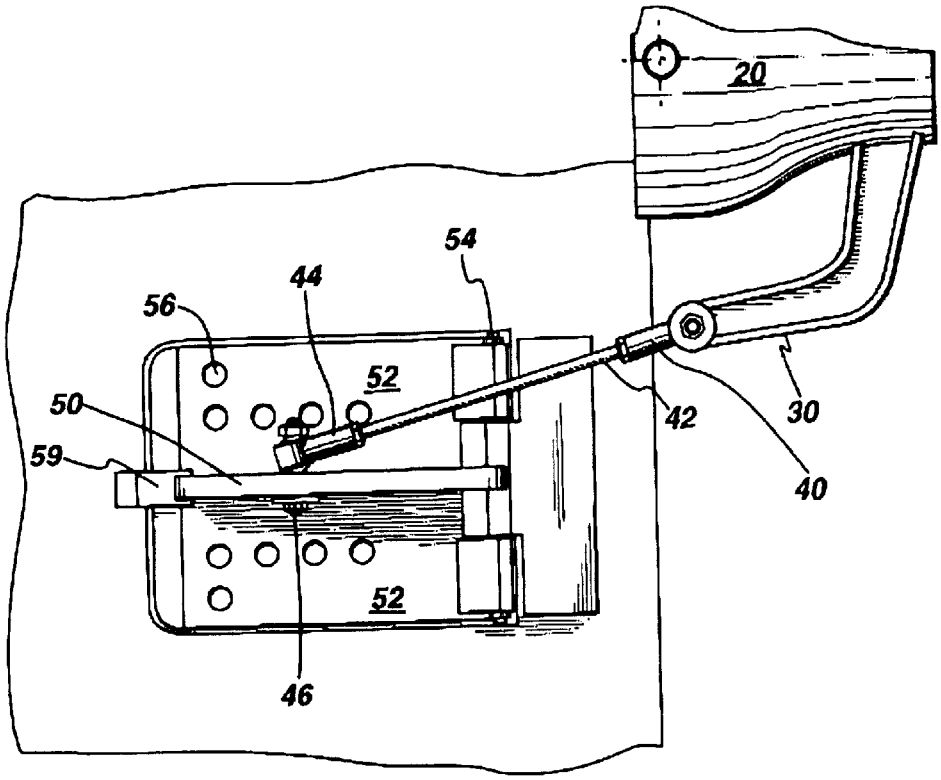
FIG. 5 is a side elevational view of a watercraft control mechanism illustrating the integration of a decelerator cable mechanism.
Figure 6:
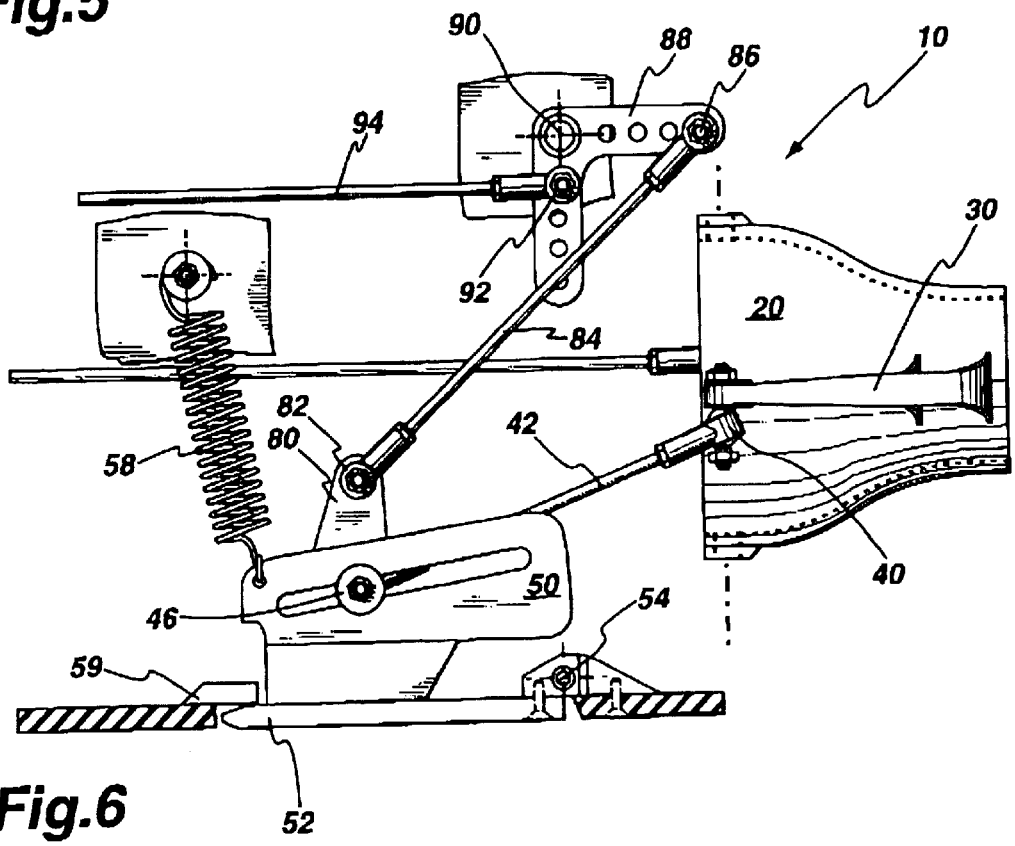
FIG. 6 is a top plan view of the watercraft control mechanism of FIG. 5.

Referring to FIGS. 5 and 6, in a preferred embodiment, the watercraft control mechanism 10 further comprises stoppers 59 to limit the travel of the tabs 52. Each tab bracket 50 further comprises a vertical extension 80 which houses a joint 82. A decelerator linkage 84 links an L-Arm 88 via an upper joint 86 to the vertical extension 80 at a lower joint 82. The L-Arm is fixed to the watercraft at a fixation 90. A decelerator cable 94 is linked to the L-Arm 88 at a decelerator cable joint 92. When the decelerator cable 94 is pulled, the L-Arm 88 pivots about the fixation 90, causing the upper joint 86 to exert a downward force on the tab bracket 80 via the decelerator linkage 84 and the lower joint 82. The tab bracket 80 transfers the downward force to the tab 52 which then pivots about the hinge 54. The tab 52 declines into the water until the tab bracket 50 collides with the stopper 59. When the tension in the decelerator cable 94 is released, the spring 58 returns the tab 52 to its neutral position wherein the tab 52 is in contact with the stopper 59.

The angle of attack of the tabs is believed to be important in optimizing the sucking effect necessary to keep the stern of the watercraft well in the water during deceleration. For instance, while an angle of attack of 15 degrees may provide near-optimal down force at the stern, an increase of only ten degrees in the angle of attack of the tabs to 25 degrees could radically diminish the down force at the stern of the watercraft.

Figure 10:
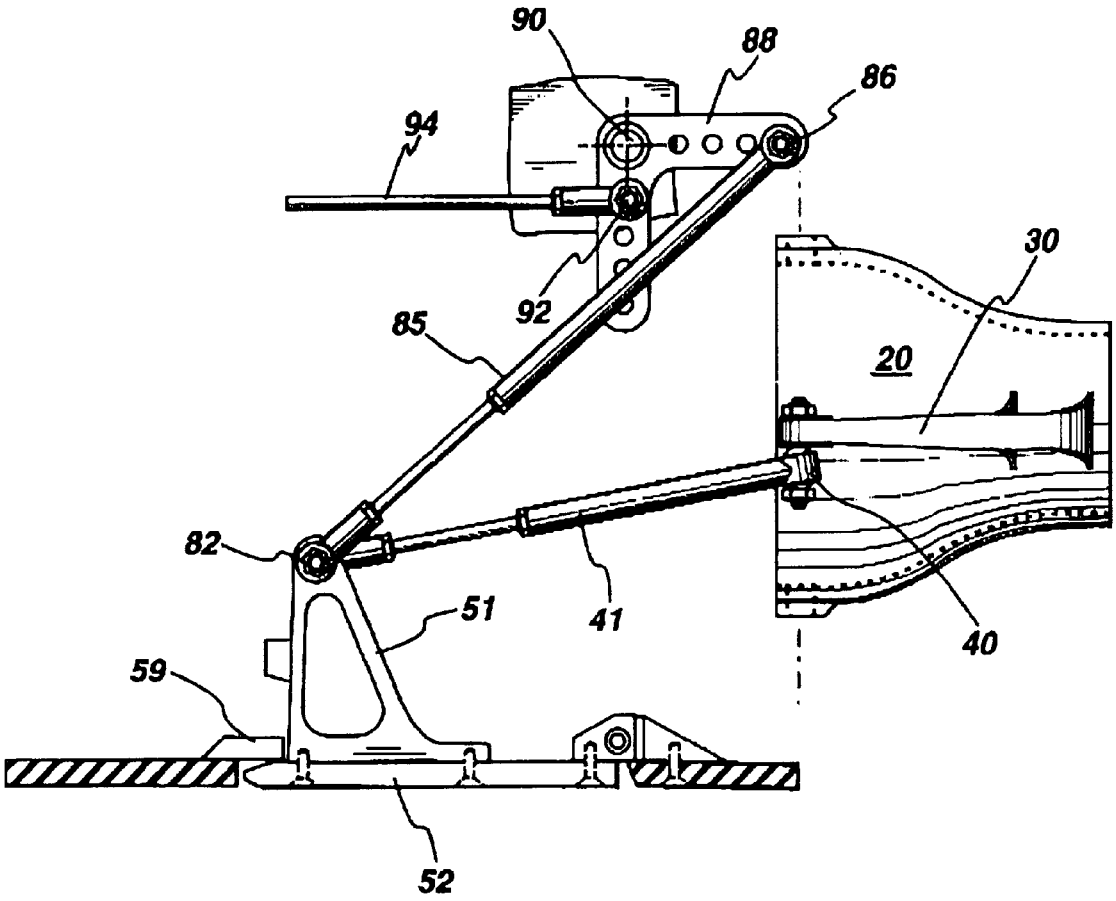
FIG. 10 shows a side view of an alternative embodiment of a watercraft control mechanism having a pivot lock capable of keeping the tab closed at high speeds and which can only be unlocked by actuation of either the decelerator linkage or the steering linkage.

A variant of the watercraft control mechanism 10, illustrated in FIG. 10, comprises a steerable nozzle 20, nozzle arms 30, and spherical rod-end bearings 40. Each spherical rod-end bearing is connected to one extremity of a telescopic link 41, the other extremity of the telescopic link 41 being connected to a lower joint 82 fixed to a tab bracket 51. Also connected to the tab bracket 51 at the lower joint 82 is telescopic decelerator linkage 85 which is connected to the L-Arm 88 at the upper joint 86. The L-Arm 88 is attached to the watercraft at the fixation 90. The decelerator cable 94 is joined to the L-Arm 88 at the decelerator cable joint 92. When the decelerator cable 94 is pulled, the L-Arm 88 pivots about the fixation 90, causing the telescopic decelerator linkage to exert a generally downward force on the tab bracket 51. The downward force exerted on the tab bracket 51 causes the tab 52 to pivot downward about the hinge 54 until the tab bracket 51 collides with the stopper 59. The declination of both tabs 52*a* and 52*b* decelerates the watercraft.

When the steerable nozzle 20 is turned, the nozzle arm 30 exerts a force on the telescopic link 41 through the spherical rod-end bearing 40. The force exerted on the telescopic link 41 causes the telescopic link 41 to compress until the telescopic link 41 runs out of travel at which point the telescopic link begins to transfer the force to the tab bracket 51 via the lower joint 82. The force exerted on the tab bracket 51 causes the tab 52 to sweep downwards about the hinge 54 until the stopper 59 collides with the tab bracket 51. Actuation of either starboard tab 52*a* or port tab 52*b* induces an offset drag force (i.e. offset with respect to the plane of symmetry of the watercraft) which creates a steering effect additional to that resulting from the steerable nozzle 20.

Figure 9:
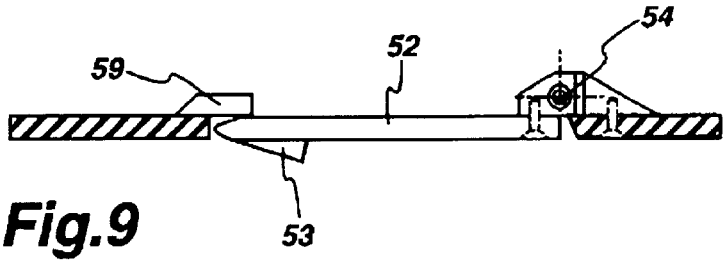
FIG. 9 shows a side elevational view of the tab of FIG. 8.
Figure 8:
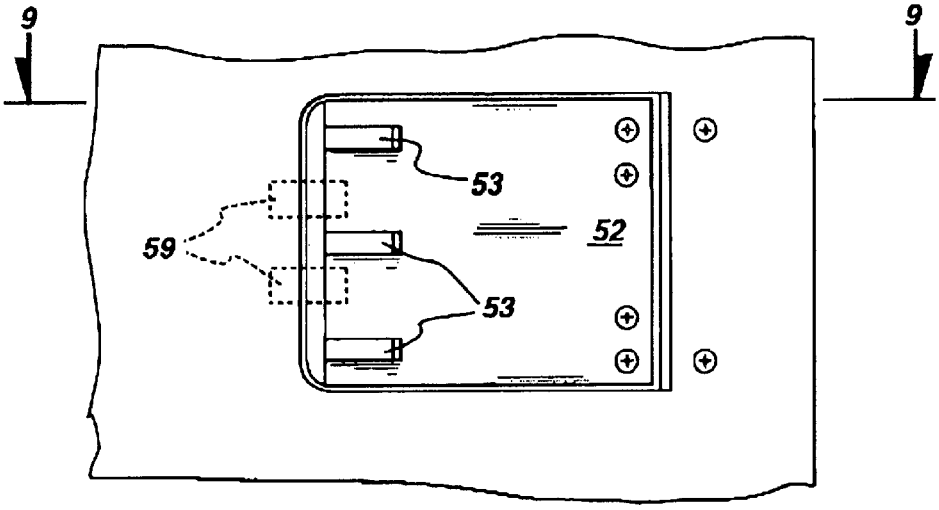
FIG. 8 shows a typical tab disposed with three small ramps which ensure that the tab remains closed at high speeds.

A variant of the tab 52, illustrated in FIGS. 8 and 9, comprises three ramps 53 mounted on the underside of the tab 52. The three ramps 53 exert an upward force on the tab 52 at high speeds to ensure that the tab 52 remains flush and that no accidental or unexpected opening of the tabs occurs at high speeds.

Figure 7:
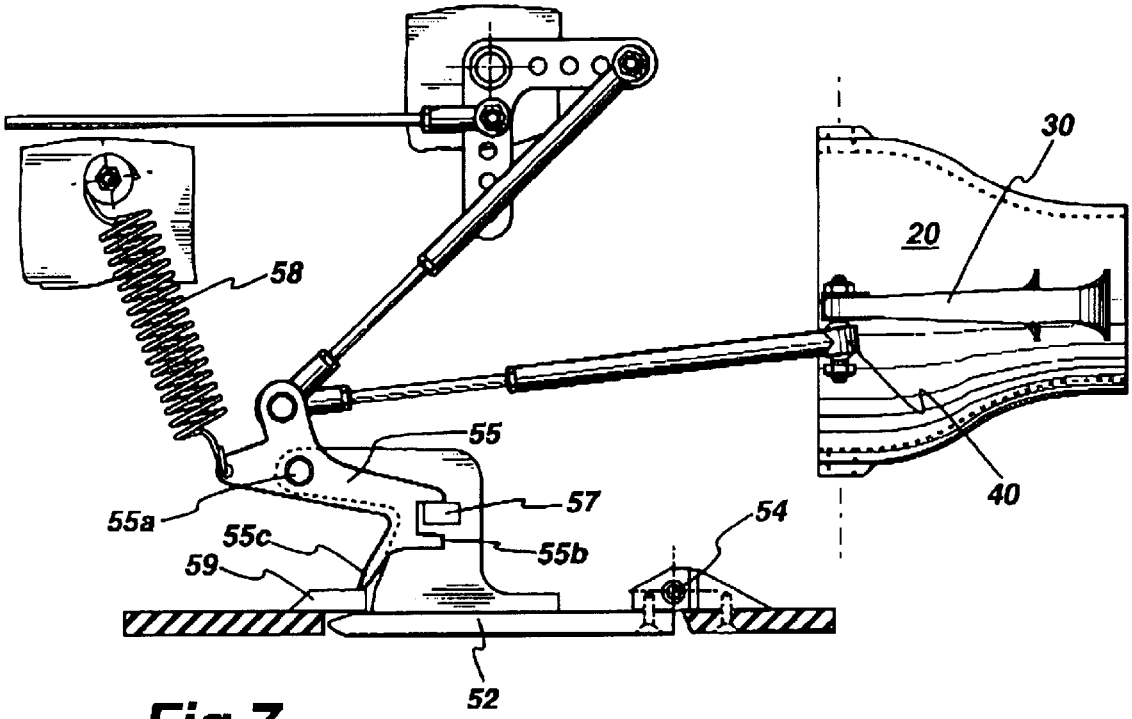
FIG. 7 is a side elevational view of another embodiment of the watercraft control mechanism, illustrating the use of telescopic linkages in lieu of slots.

Another embodiment of the watercraft control mechanism 10, illustrated in FIG. 7, comprises a pivot lock 55 and a lock stopper 57 to achieve the same objective as the tab 52 illustrated in FIGS. 8 and 9 but without augmenting the drag on the underside of the watercraft. The spring 58 exerts an upward force on the pivot lock 55. During either deceleration or steering, the pivot lock 55 rotates about a pivot 55*a*, urging an arm 55*b* of the pivot lock 55 to sweep upwards into contact with the lock stopper 57. This causes a lower extension 55*c* of the pivot lock 55 to unlock the stopper 59, thereby enabling the tab 52 to pivot freely about the hinge 54. When deceleration or steering ceases, the spring 58, which is under tension, urges the tab 52 back to its neutral position (i.e. flush with the ride plate 60). The spring 58 may also be assisted by reversing the load on the deceleration cable 94 or on the push-pull steering cable 70. As the tab 52 returns to its position flush with the ride plate 60, the lower extension contacts the stopper 59 and the lock stopper 57 contact the pivot lock 55 as shown in FIG. 10, thereby locking the tab 52 and preventing the tab 52 from opening accidentally.

Figure 12:
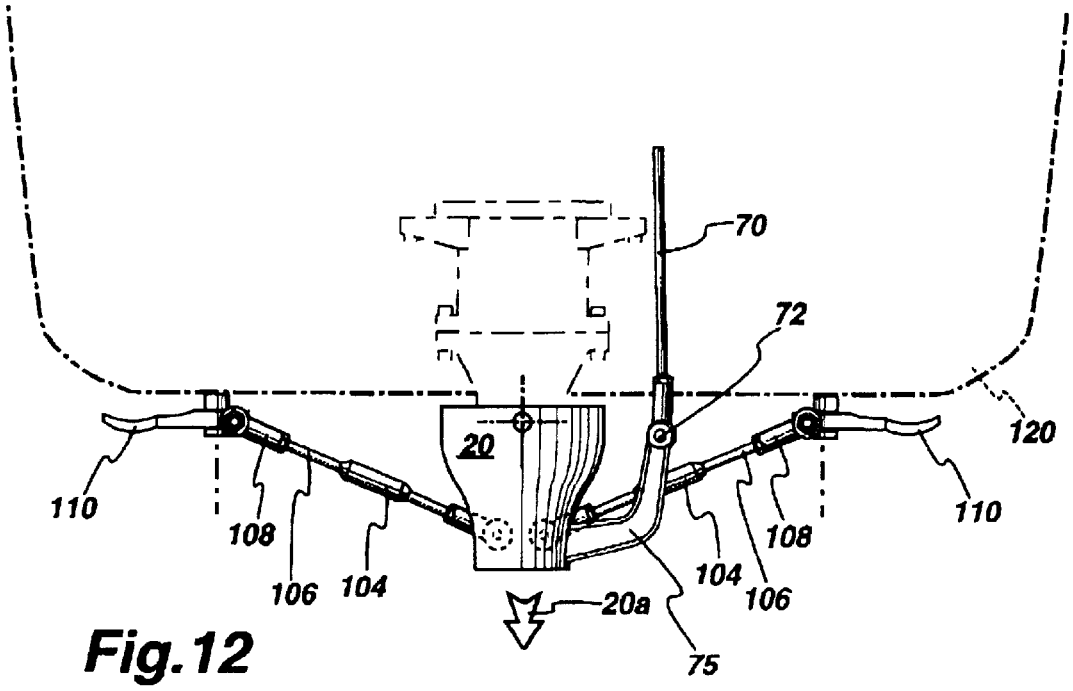
FIG. 12 is a top plan view of the embodiment of the watercraft control mechanism of FIG. 11.
Figure 11:
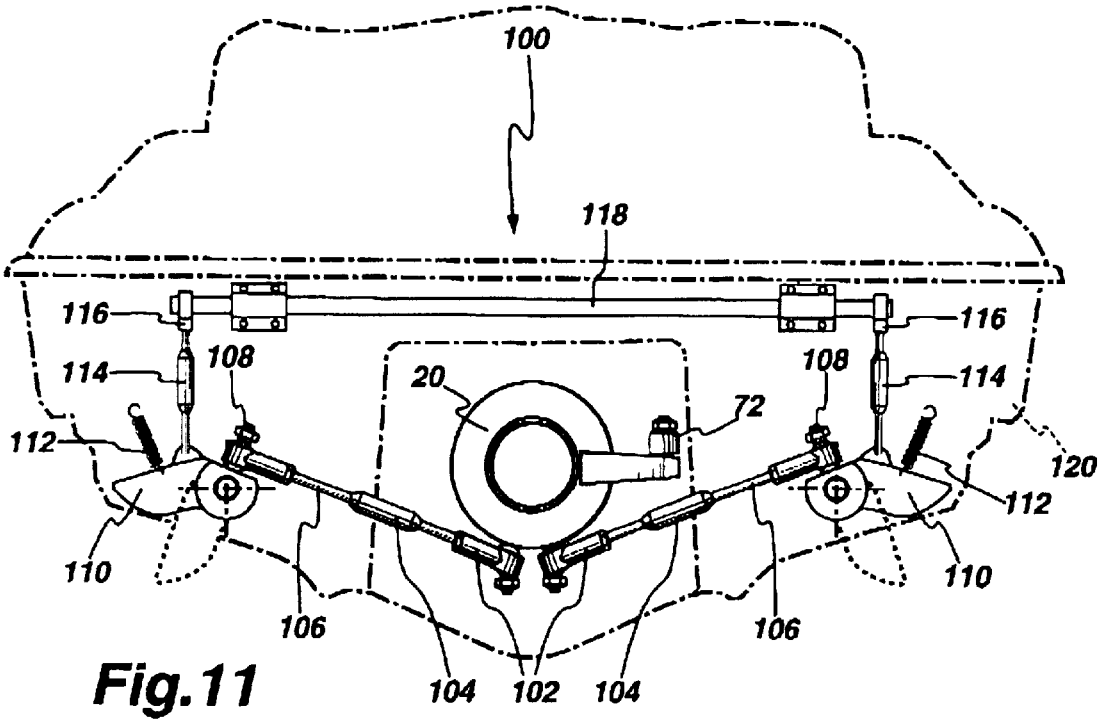
FIG. 11 is a rear elevational view of another embodiment of the watercraft control mechanism in which the linkages coupling the tabs to the nozzle are substantially perpendicular to the thrust vector of the propulsion source.

Referring to FIGS. 11 and 12, an alternative embodiment of a watercraft control mechanism 100 comprises a steerable nozzle 20, a steering arm 75, a steering joint 72 and a push-pull steering cable 70. The steerable nozzle is connected to a pair of spherical rod-end bearings 102. Each spherical rod-end bearing is joined to a transverse damper 104 and a transverse linkage 106 each of which is angled substantially perpendicularly to the thrust vector 20*a* of the steerable nozzle 20. Joints 108 link the transverse linkages to tabs 110 which, when actuated by the turning of the steerable nozzle 20, swing into the water to create a drag-steering effect. Springs 112, vertical dampers 114 and vertical linkages 116 connect the tabs 110 to a transom bar 118 mounted transversely along on the stern 120 of the watercraft.

Figure 13:
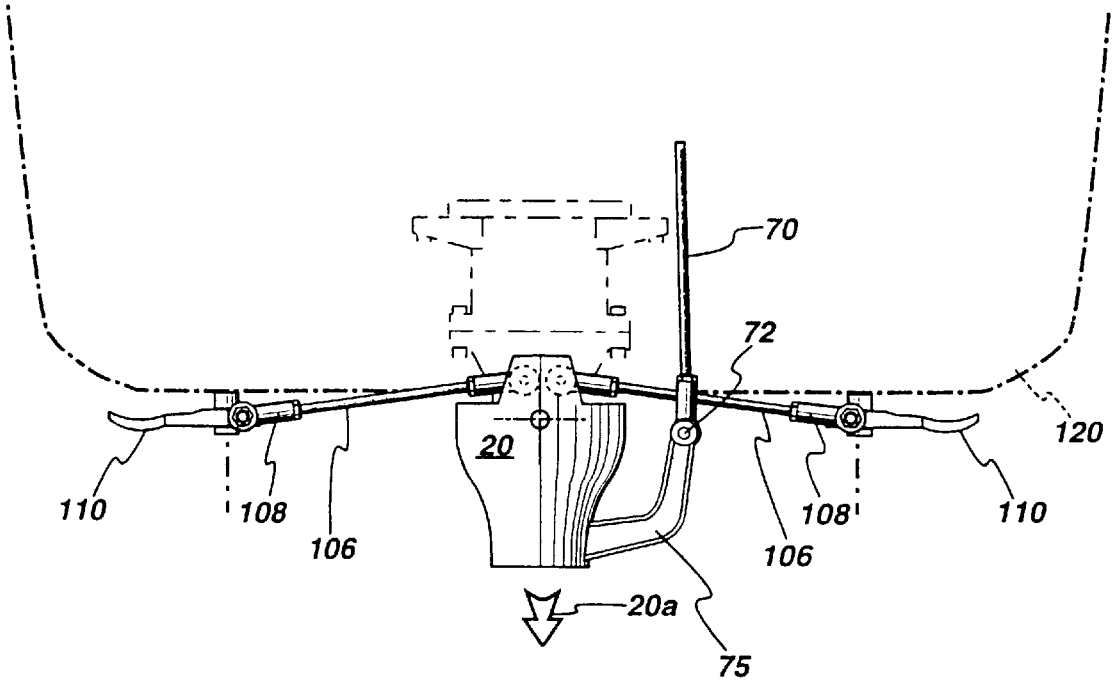
FIG. 13 is a top plan view of a variant of the embodiment of FIG. 12, wherein the transverse linkages are attached to the nozzle near the inlet of the nozzle.

FIG. 13 illustrates a variant of the embodiment shown in FIGS. 11 and 12. In the variant of FIG. 13, the transverse linkages 106 are mounted to the steerable nozzle 20 near the nozzle's inlet while, in FIGS. 11 and 12, the transverse linkages 106 are mounted to the steerable nozzle 20 near the nozzle's outlet. When the transverse linkages 106 are attached to the steerable 16 nozzle 20 near the nozzle inlet (as in FIGS. 11 and 12), a given angular displacement of the steerable nozzle 20 results in a small displacement of the tabs 110. When the transverse linkages 106 are attached to the steerable nozzle 20 near the nozzle outlet, a given angular displacement of the steerable nozzle 20 results in a comparatively larger displacement of the tabs 110.

Figure 14:
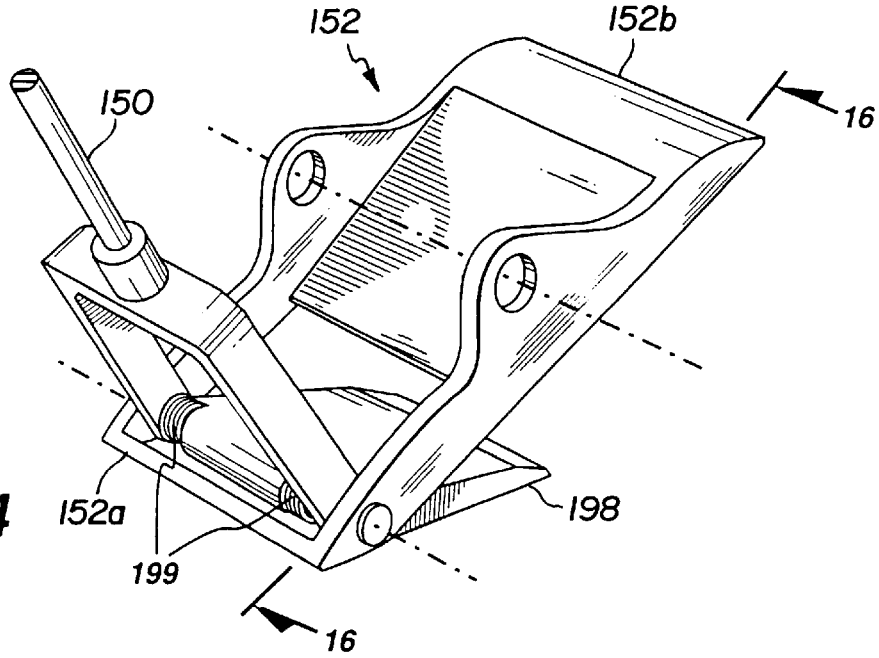
FIG. 14 is a perspective view of a tab for a watercraft control mechanism having a spring-loaded flap that is forced open at high flow velocity.
Figure 15:
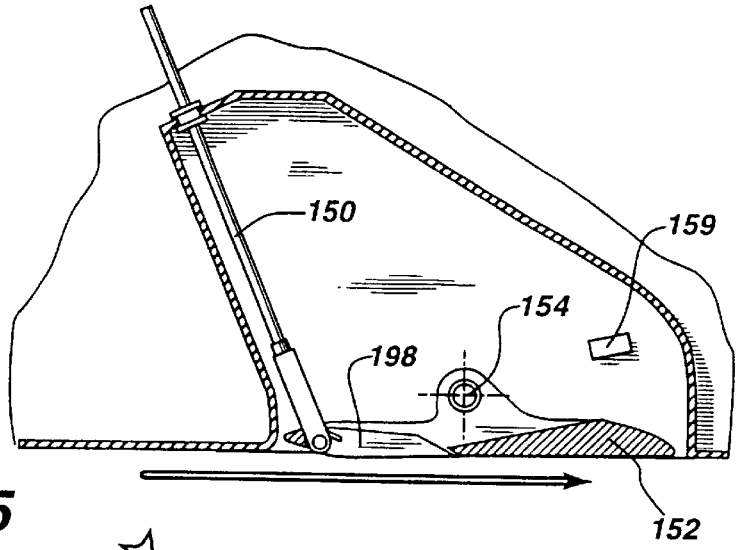
FIG. 15 is a side elevational view of the tab of FIG. 14 shown in its neutral position flush with the ride plate.
Figure 16:
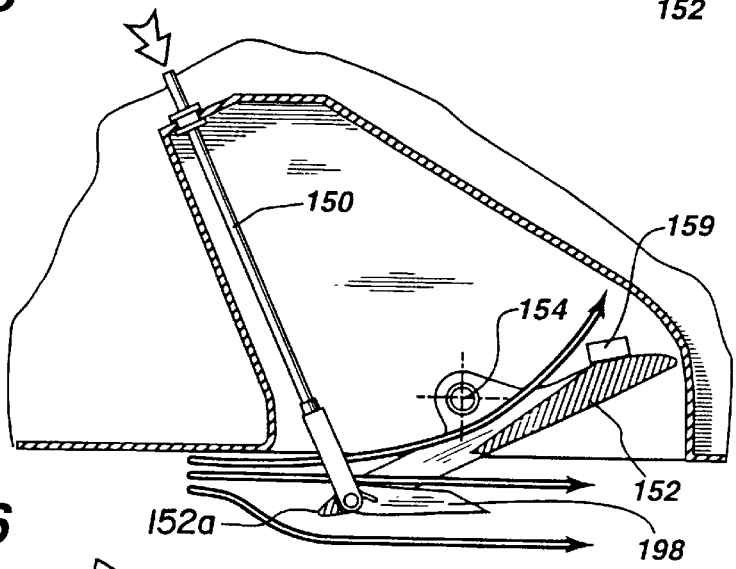
FIG. 16 is a side elevational view of the tab of FIG. 15 shown in its decelerating position with its leading edge declined into the flow and the spring-loaded flap open.
Figure 17:
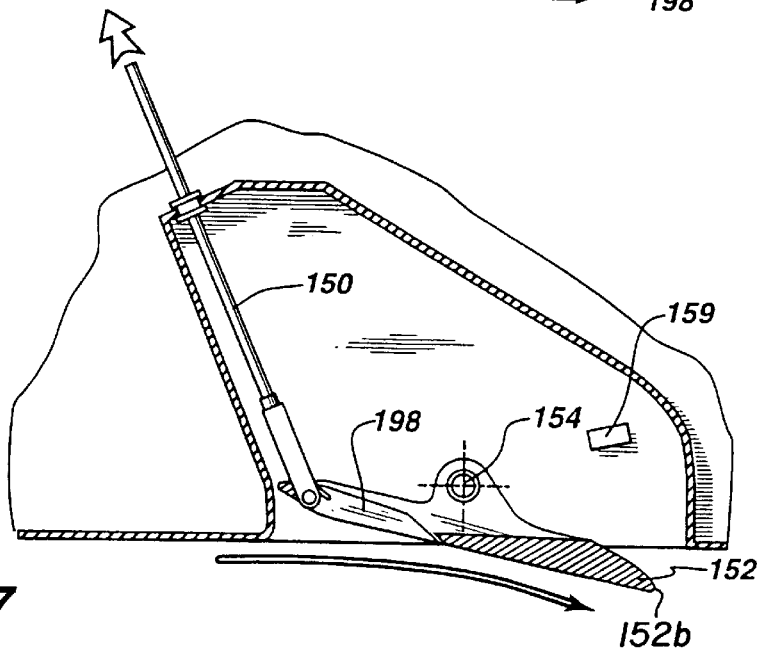
FIG. 17 is a side elevational view of the tab of FIG. 15 shown in its trimming position with its trailing edge declined into the flow.

Referring to FIGS. 14, 15, 16 and 17, there figures illustrate tab 152 that is a variant of a tab 52 comprises a control linkage 150 activated by the driver, a pivot 154 fixed to the watercraft and about which tab 152 is free to rotate, and a stopper 159, also attached to the watercraft. The tab 152 further comprises a spring-loaded flap 198 and rotational springs 199. When the control linkage 150 is actuated for deceleration, a downward force is exerted on the leading edge 152*a* of the tab 152, causing the tab 152 to rotate about the pivot 154 until the rear of the tab collides with the stopper 159. When the leading edge is inclined into the water, deceleration of the watercraft occurs. At high speeds, the momentum of the water colliding with the tab 152 can induce large tensile stresses in the control linkage and may also provide deceleration that is too severe. In order to alleviate the substantial drag of the tab 152 at high speeds, the tab 152 comprises a spring-loaded flap 198 which opens at high speeds as illustrated in FIGS. 14 and 16. The spring-loaded flap 198 is pinned to the tab 152 and preferably restrained by two rotational springs 199. When the momentum of the water colliding with the exposed portion of the tab 152 is decreased as the watercraft slows, the rotational springs 199 urge the spring-loaded flap back to its neutral position, flush with the bottom surface of the tab 152. When the tab 152 is returned to its neutral position as shown in FIG. 15, the control linkage exerts on upward force on the tab 152 near the leading edge 152*a*, thereby causing the tab 152 to rotate about the pivot 154 until the tab 152 reaches its neutral position. For trimming, the control linkage 150 exerts an upward force on the tab 152 near the leading edge 152*a* thereby causing the tab 152 to rotate about the pivot 154 such that the trailing edge 152*b* declines into the water.

To return the tab 152 to the neutral position of FIG. 15, downward force is exerted on the tab 152 until it reaches the neutral position.

Figure 18:
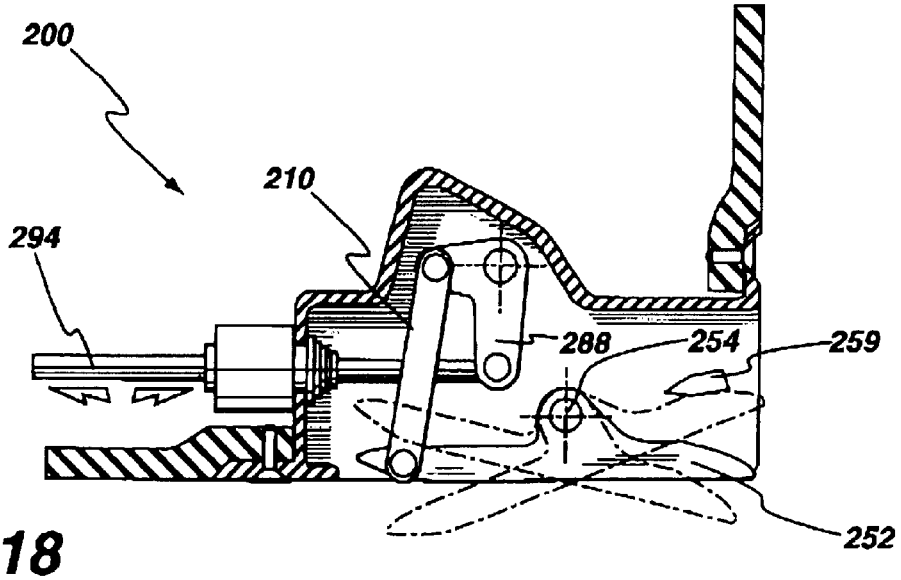
FIG. 18 is a side elevational view of a trim-tab mounted flush-fitted underneath the hull at the stern of the watercraft.
Figure 19:
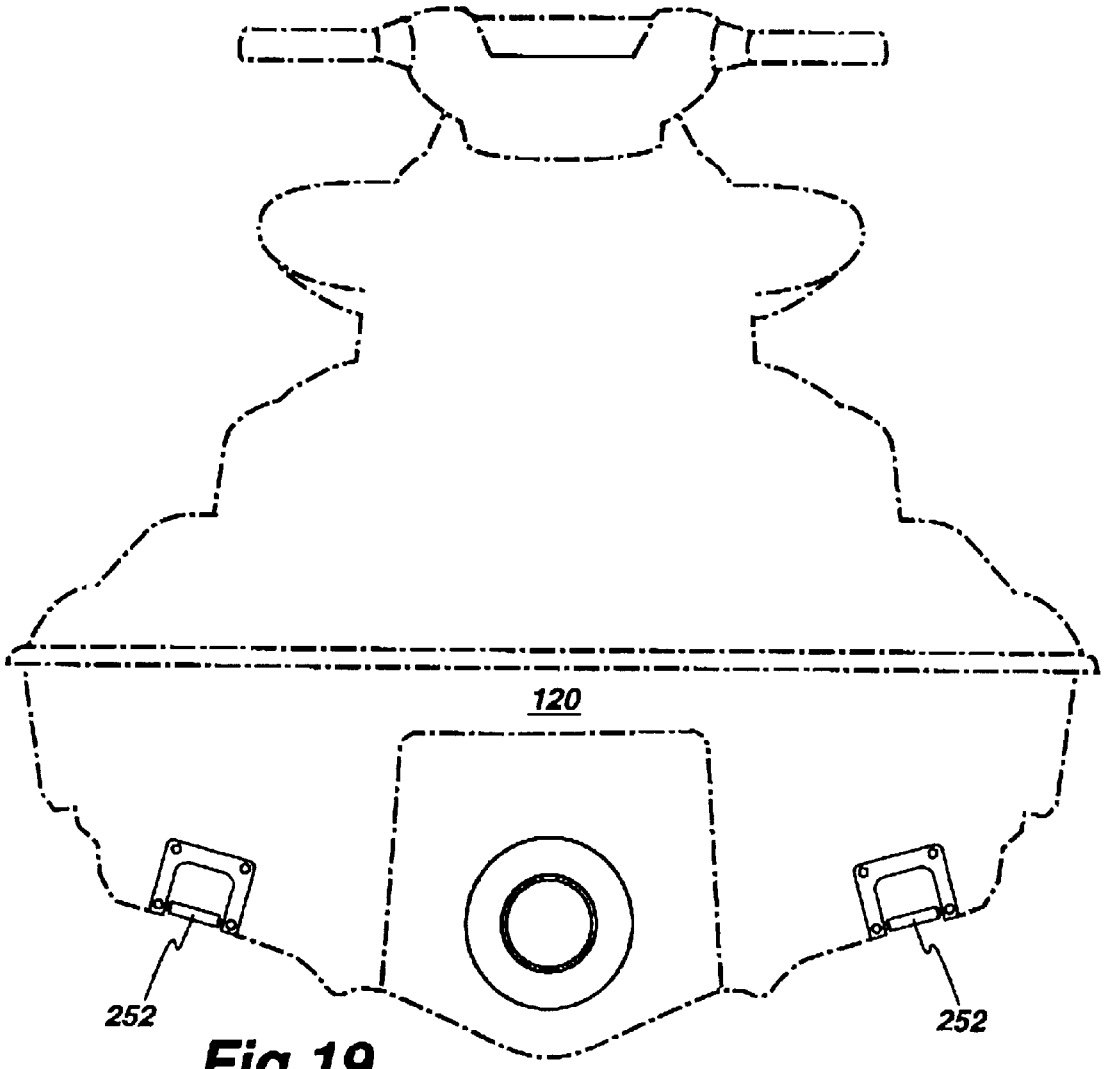
FIG. 19 is a rear view illustrating the integration of the flush-fitted trim-tabs of FIG. 18 to the hull.

FIGS. 18 and 19 illustrate another embodiment of a watercraft control mechanism 200 comprising a tab 252 flush-fitted with the hull of the watercraft. This is especially advantageous for personal watercraft which are often beached or travel in very shallow water. The watercraft control mechanism 200 includes an actuation linkage 294 which is generally parallel to the tab 252 in its neutral (flush) position. The watercraft control mechanism further includes a vertical link 210 capable of exerting a generally vertical force on the tab 252 near its leading edge. The watercraft control mechanism further includes an L-Arm 288 capable of pivoting about a point fixed to the watercraft hull and capable of converting the generally horizontal force exerted by the actuation linkage 294 to a generally vertical force onto the tab 252. In addition, the watercraft control mechanism includes a stopper 259 to limit the declination of the tab 252. In operation, generally horizontal forces exerted upon the L-Arm 288 by the actuation linkage 294 cause either the leading edge or the trailing edge of the tab 252 to contact the water, thereby creating drag for steering, deceleration or trimming.

FIGS. 20 and 21 illustrate another embodiment of a tab 352 for use in a watercraft control mechanism as disclosed herein. The tab 352 is shown mounted integrally with the ride plate 60. The tab 352 pivots about a hinge 354. At high speeds, if the momentum of the water impinging on the exposed portion of the tab 352 exceeds the torque exerted by the rotational springs 199 on the spring-loaded flap 198, then the spring-loaded flap 198 opens and alleviates the pressure acting on the tab 352, thereby attenuating the tensile stresses in the actuation linkage (not shown).

FIGS. 22 and 23 illustrate tab 452 which is a variant of tab 352. Tab 452 comprises a pair of stoppers 459 that limit the range of declination of the tab 452 as it pivots about the hinge 454. FIGS. 24 and 25 show the tab 452 in its open configuration and in its closed configuration, respectively.

FIG. 26 illustrates a hooked tab 552, a variant of tab 52, that rotates about a pivot 554. Unlike the flat prior art tabs that sweep downward from the stern of the watercraft and cause the stern to lift, the hooked tab 552 catches the water and sucks the watercraft downward. The hooked tab 552 would be actuated by an actuation linkage similar to the actuation linkages shown in FIGS. 14–17.

Figure 27:
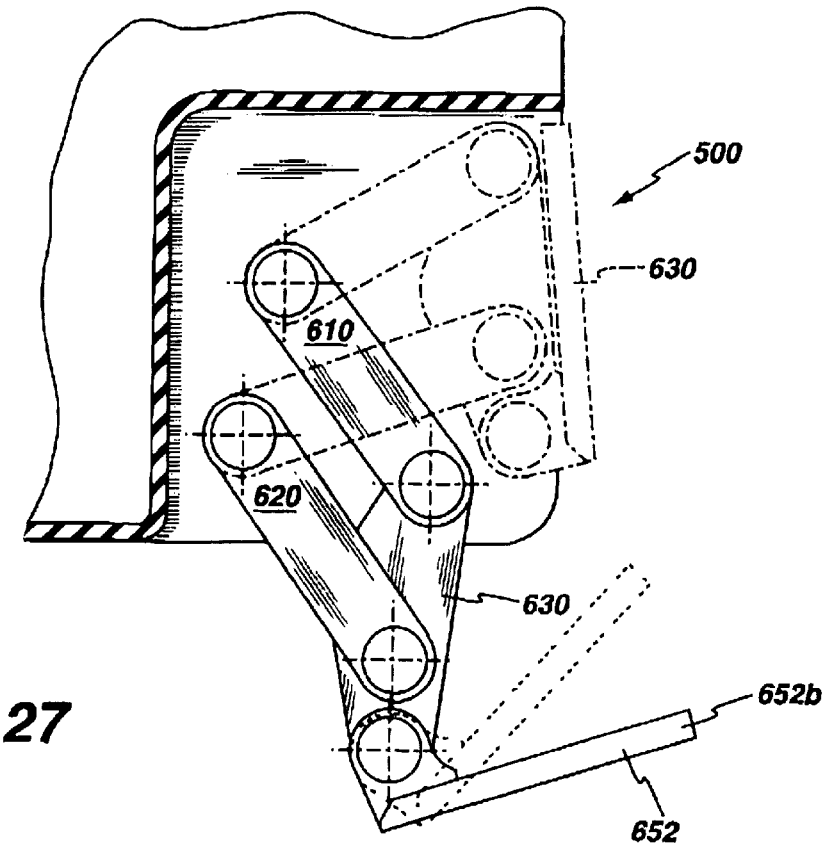
FIG. 27 is a side elevational view of another embodiment of a pivoting watercraft control mechanism shown in its deployed configuration and in its retracted configuration.

FIG. 27 illustrates yet another embodiment of the watercraft control mechanism 600 comprising a first arm 610 and a second arm 620 which are generally parallel to one another. Arms 610 and 620 are pivotally mounted preferably to the stern of the watercraft and are also pivotally connected to a transverse link 630. A tab 652 is pivotally connected to one end of the transverse link 630 near the leading edge 652*a* of the tab 652. Linear or rotational actuators can be used to displace the arms 610 and 620 and then to vary the angle of attack of the tab 652. In its stowed position (shown in stippled lines), the tab 652 is well above the waterline. When deployed, the arms 610 and 620 swing downward. The leading edge of the tab 652*a* can be inclined into the water (by an actuator not shown in FIG. 27) thereby creating a drag force to either steer or decelerate the watercraft.

Alternatively, the trailing edge 652*b* of the tab 652 can be dipped into the water to trim the watercraft. One of the main advantages of the embodiment illustrated in FIG. 27 is its capacity to stow the tab and its associated mechanism safely above the bottom of the hull so that a watercraft featuring such a watercraft control mechanism could be beached or used in extremely shallow water without risk of damaging the exposed parts of the watercraft control mechanism.

Figure 28:
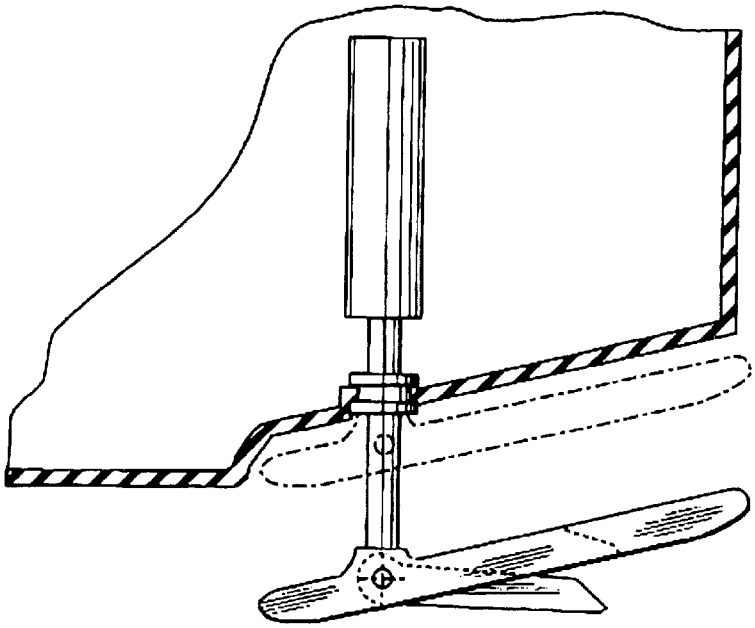
FIG. 28 is a side elevational view of another embodiment of a translational watercraft control mechanism shown in its deployed position and in its retracted position.

Illustrated in FIG. 28 is a watercraft control mechanism whose tab or tabs are fixed at an angle of inclination of approximately 15 degrees. Such a watercraft control mechanism could be used only for steering or decelerating, and not for trimming. The tab or tabs are translated from a retracted or stowed position (as shown in dotted lines) to an operative or submerged position (as shown in solid lines) by one or more linear actuators. Although FIG. 28 presents a simple vertically-oriented actuator, it should be known to those skilled in the art that there are many equivalent mechanisms that could be just as easily implemented for raising and lowering the tab or tabs. It should also be noted that the determination of the optimal angle of inclination of the tabs as well as a hydrodynamically optimal tab profile are merely matters of routine experimentation.

Figure 29:
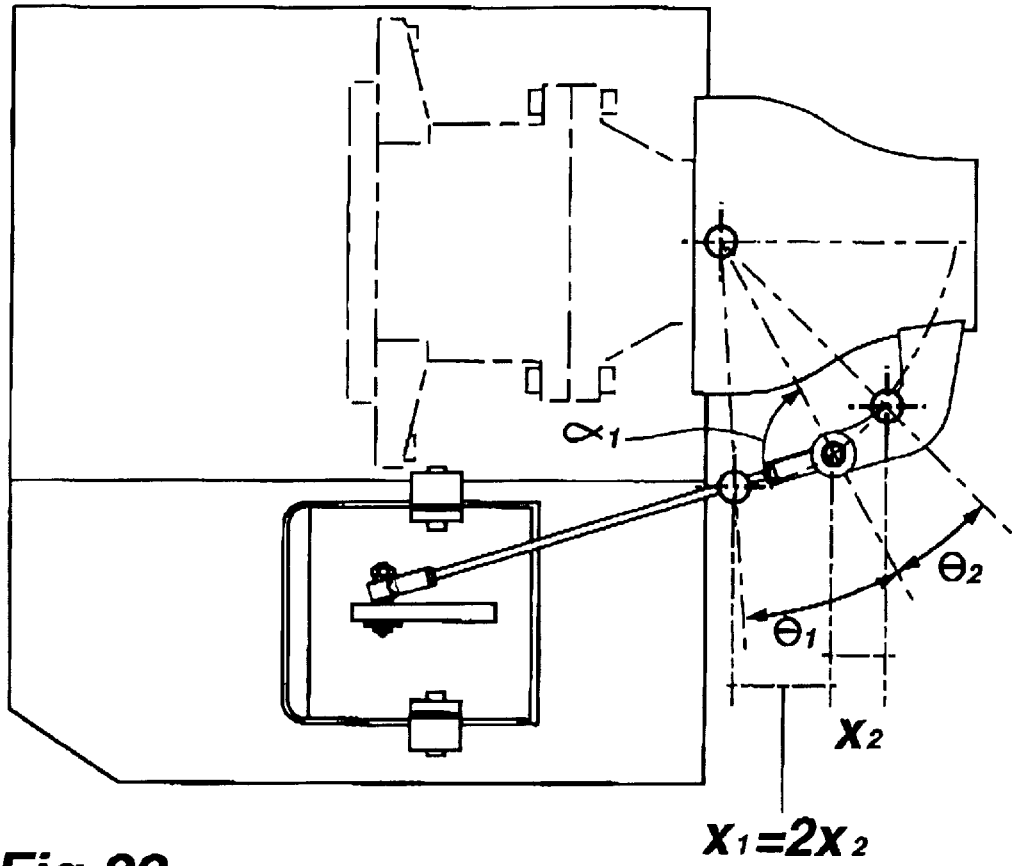
FIG. 29 is a geometric analysis in a plan view showing how the motion of the tabs is coupled to that of the nozzle when the point of fixation is offset on the nozzle.
Figure 30:
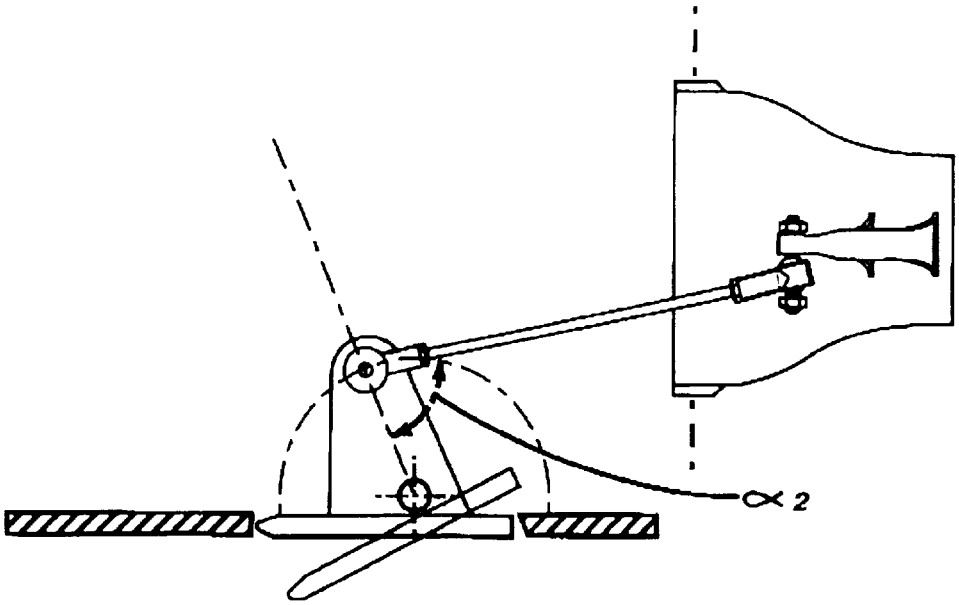
FIG. 30 is a side view of the geometric analysis of FIG. 29.
Figure 31:
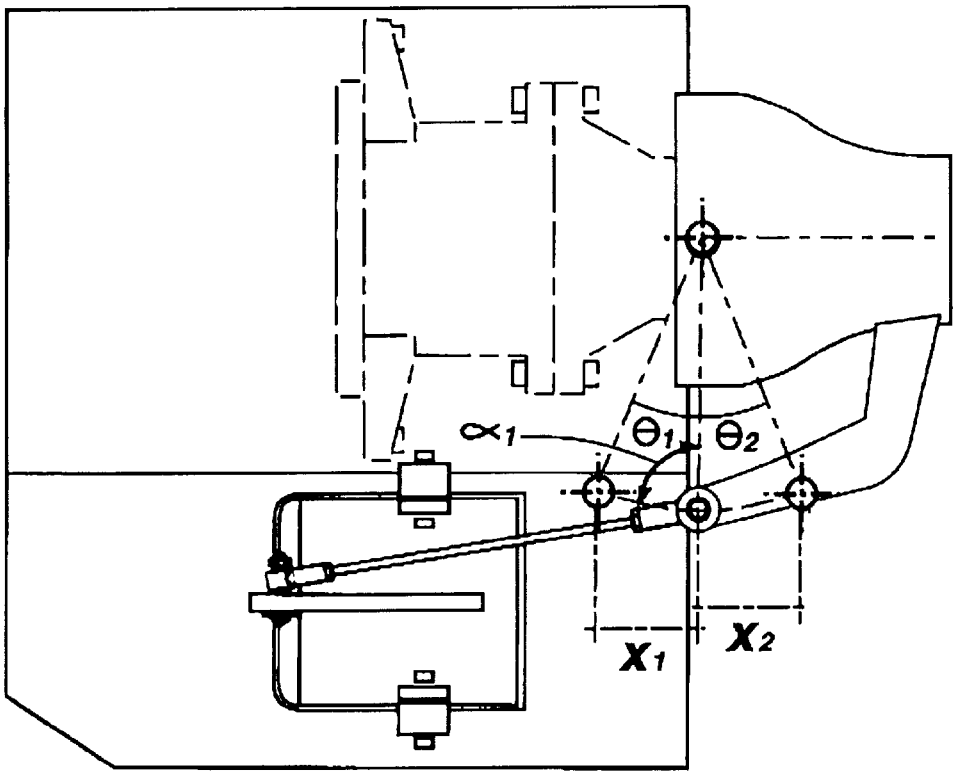
FIG. 31 is a geometric analysis in a plan view showing how the motion of the tabs is coupled to that of the nozzle when the point of fixation is offset on the tabs.
Figure 32:
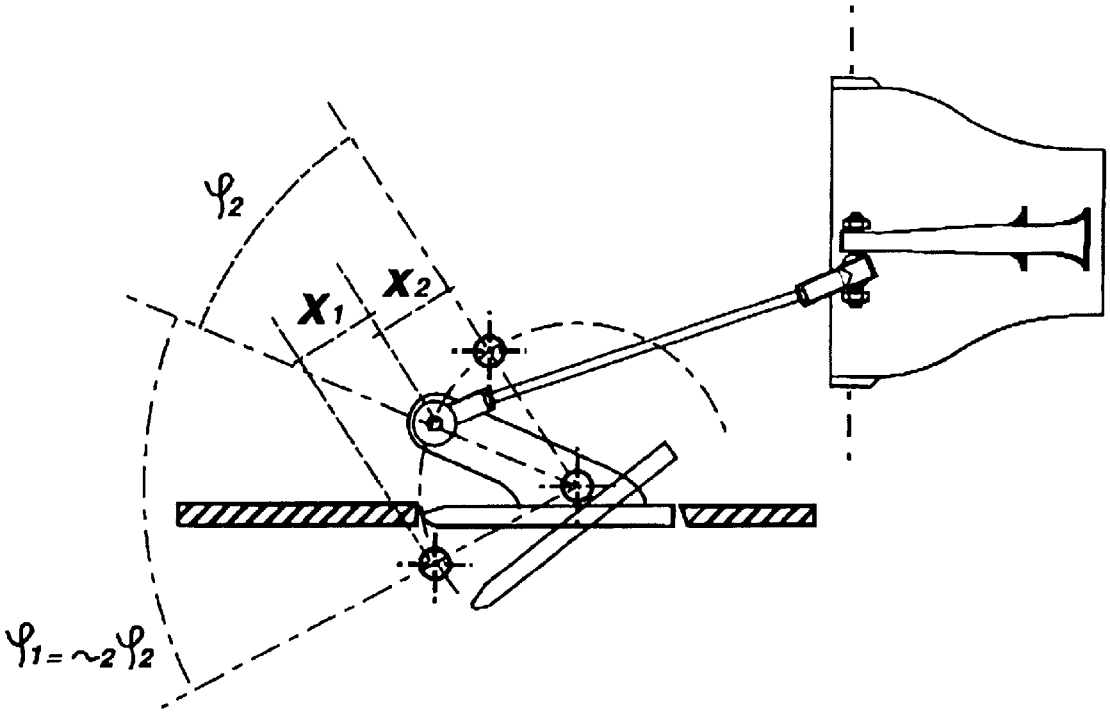
FIG. 32 is a side view of the geometric analysis of FIG. 31.

FIGS. 29, 30, 31 and 32 illustrate how it is possible to achieve a non-proportional actuation of the tabs 52. FIGS. 29 and 30 show an actuating linkage fixed to a nozzle arm such that it is offset from the axis of rotation of the nozzle. FIGS. 31 and 32 show an actuating linkage fixed to a tab such that it is offset from the pivot axis of the tab. In FIGS. 29 and 30, an angular displacement of the port nozzle arm results in the actuating linkage traveling twice as far when the port nozzle arm is turned to port than when it is turned to starboard. In FIGS. 31 and 32, the actuating linkage fixed to the port nozzle arm travels equal distances but, due to the offset fixation of the actuating linkage on the tab, the angular displacement of the tab is twice as large in declination as it is in inclination.

Figure 3:
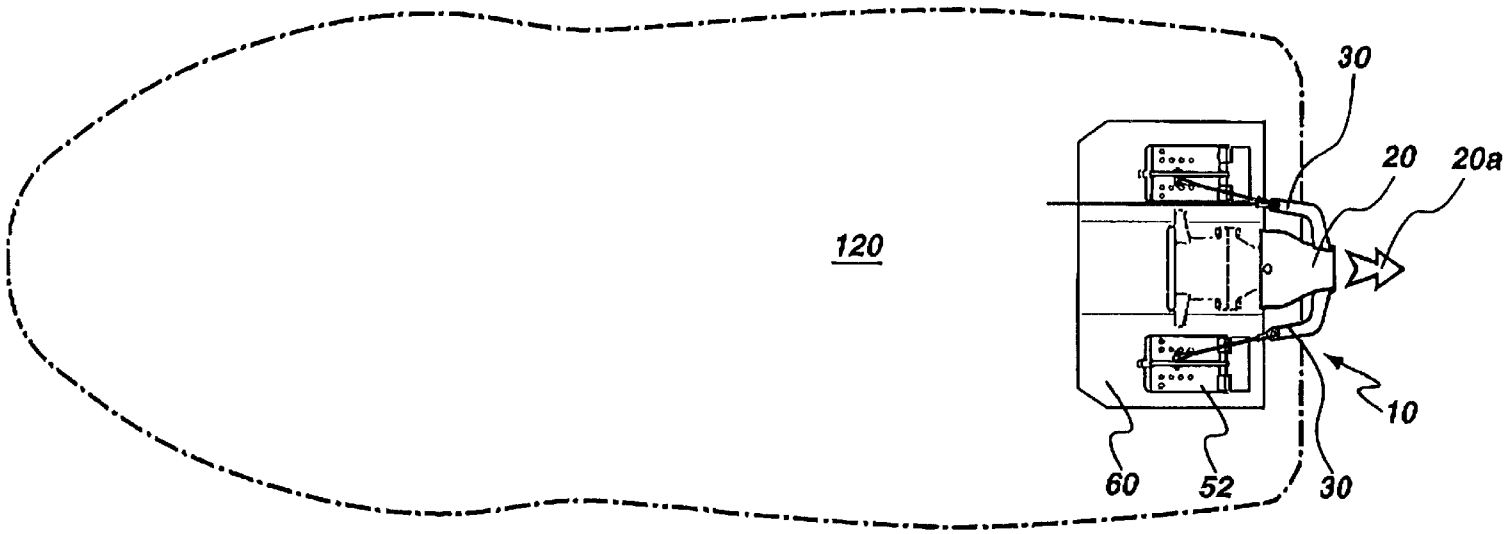
FIG. 3 is a side elevational view of a watercraft control mechanism with a watercraft shown in stippled lines.
Figure 4:
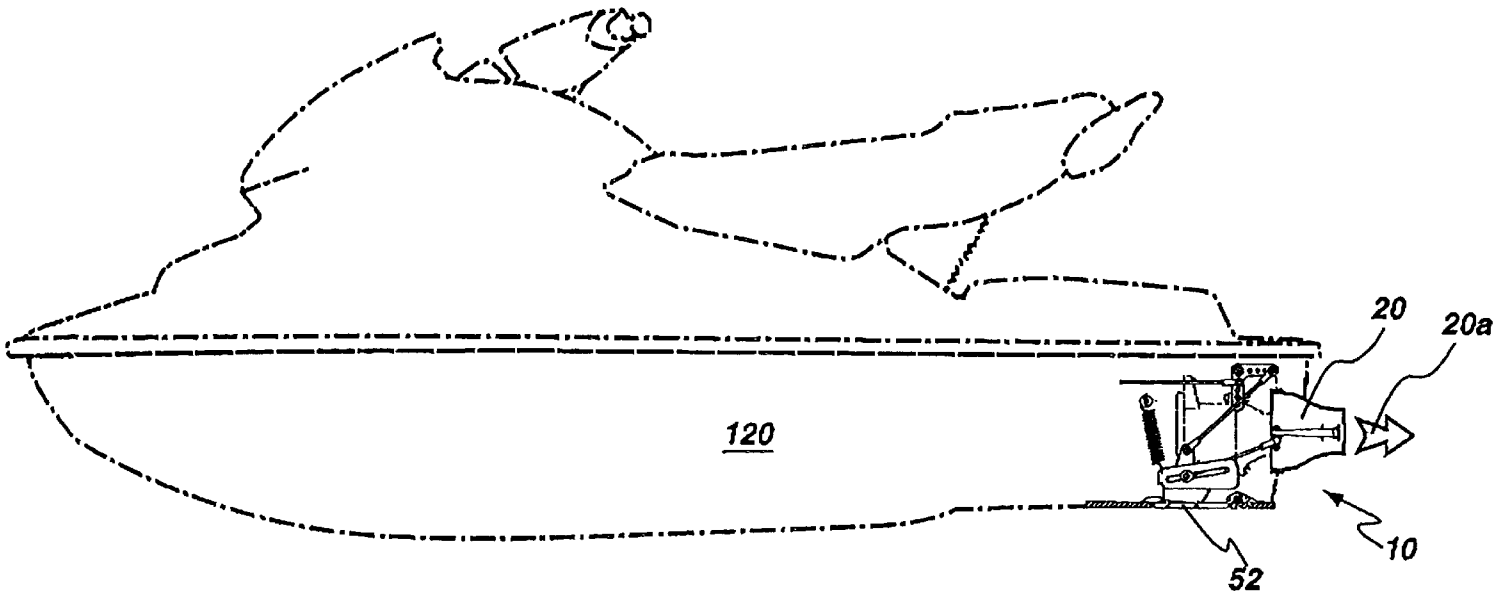
FIG. 4 is a top plan view of a watercraft control mechanism with a watercraft shown in stippled lines.

Each of the foregoing embodiments of the watercraft control mechanism preferentially employs two tabs (as illustrated in FIGS. 1, 3 and 19) in order to steer the watercraft. It should be obvious to one skilled in the art that in lieu of two tabs, the watercraft control mechanism could equivalently have four or six or any even number of tabs. Activating three smaller tabs on the starboard side, for instance, would therefore be essentially equivalent to activating a single large tab on the starboard side. Furthermore, the watercraft control mechanism could be equipped with an odd number of tabs with one central tab straddling the plane of symmetry of the boat so that the central tab would perform strictly a decelerating role, contributing nothing to the steering. Another possible variant of the embodiments presented above would be to employ but a single, central tab for deceleration purposes only.

Another embodiment of the watercraft control mechanism not shown in the drawings would entail an electronic feedback control system capable of sensing the angle of the steerable nozzle, degree of decelerator cable actuation as well as watercraft speed, pitch, roll and wave conditions. Such an electronic control system would be able to activate solenoids or electric motors to make rapid and precise adjustments to the angle of the tabs in relation to the input parameters. Furthermore, in the foregoing description of preferred embodiments, it would be obvious to one skilled in the art that many of the mechanical components and sub-systems, chosen for their mechanical simplicity and reliability could be replaced by more complex albeit functionally equivalent component and sub-systems involving solenoids or electric motors. Therefore, the above description of preferred embodiments should not be interpreted in a limiting manner since other variations, modifications and refinements are possible within the spirit and scope of the present invention. The scope of the invention is defined in the appended claims and their equivalents.

What is claimed is:

1. A control mechanism for a watercraft, said mechanism comprising:

(a) a steerable propulsion source;

(b) a steering controller for controlling said steerable propulsion source;

(c) a linking member connected to said steerable propulsion source;

(d) at least one tab connected to said linking member, said at least one tab moveable between an inoperative position and an operative position whereby said at least one tab can be angled such that, in the operative position and when said watercraft is traveling upright in water in a substantially forward direction, a volume of water impinges on a top surface of said at least one tab thereby creating a downward and rearward force on said watercraft.

2. A control mechanism for a watercraft as recited in claim 1 wherein said at least one tab is translationally displaceable between said inoperative position and said operative position.

3. A control mechanism for a watercraft as recited in claim 1 wherein said at least one tab is pivotally displaceable between said inoperative position and said operative position.

4. A control mechanism for a watercraft as recited in claim 1 wherein said at least one tab has a variable surface.

5. A control mechanism for a watercraft as recited in claim 4 wherein said variable surface includes a section that is moveable with respect to said at least one tab to allow a volume of water to pass through said at least one tab.

6. A control mechanism for a watercraft as recited in claim 5 wherein said variable section is a pivotal flap that can move from a closed position to an open position.

7. A control mechanism for a watercraft as recited in claim 6 wherein said pivotal flap comprises a resilient member capable of exerting a resilient force, said resilient member adapted to urge said pivotal flap from said open position back to said closed position when a force tending to open said at least one flap is less than said resilient force.

8. A control mechanism for a watercraft as recited in claim 7 wherein said resilient member comprises a rotational spring.

9. A control mechanism for a watercraft as recited in claim 1 wherein said mechanism further comprises a stopper for limiting said at least one tab in its operative position.

10. A control mechanism for a watercraft as recited in claim 1 wherein said propulsion source defines a propulsion axis and wherein at least two tabs are disposed laterally and substantially equally distant from said propulsion axis to form a substantially symmetrical arrangement.

11. A control mechanism for a watercraft as recited in claim 1 wherein said at least one tab is hooked.

12. A control mechanism for a watercraft as recited in claim 1 wherein said at least one tab is mounted at a stern portion of said watercraft.

13. A control mechanism for a watercraft as recited in claim 1 further comprising a decelerating actuation mechanism for displacing at least one tab from the inoperative position to the operative position for creating a downward and rearward force on said watercraft.

14. A control mechanism for a watercraft as recited in claim 13 wherein said at least one tab is translationally displaceable between said inoperative position and said operative position.

15. A control mechanism for a watercraft as recited in claim 13 wherein said at least one tab is pivotally displaceable between said inoperative position and said operative position.

16. A control mechanism for a watercraft as recited in claim 13 wherein said at least one tab has a variable surface.

17. A control mechanism for a watercraft as recited in claim 16 wherein said variable surface includes a section that is moveable with respect to said at least one tab to allow a volume of water to pass through said at least one tab.

18. A control mechanism for a watercraft as recited in claim 17 wherein said variable section is a pivotal flap that can move from a closed position to an open position.

19. A control mechanism for a watercraft as recited in claim 18 wherein said pivotal flap comprises a resilient member capable of exerting a resilient force, said resilient member adapted to urge said pivotal flap from said open position back to said closed position when a force tending to open said at least one flap is less than said resilient force.

20. A control mechanism for a watercraft as recited in claim 19 wherein said resilient member comprises a rotational spring.

21. A control mechanism for a watercraft as recited in claims 20 wherein said mechanism further comprises a stopper for limiting the tab in its operative position.

22. A control mechanism for a watercraft as recited in claim 13 wherein said propulsion source defines a propulsion axis and wherein at least two tabs are disposed laterally and substantially equally distant from said propulsion axis to form a substantially symmetrical arrangement.

23. A control mechanism for a watercraft as recited in claim 13 wherein said at least one tab is hooked.

24. A control mechanism for a watercraft as recited in claim 13 wherein said at least one tab is mounted at a stern portion of said watercraft.

25. A control mechanism for a watercraft, said mechanism comprising:

(a) a deceleration actuation mechanism; and (b) at least one tab capable of being activated by said decelerating actuation mechanism, said at least one tab moveable between an inoperative position and an operative position whereby said at least one tab can be angled such that, in the operative position, a volume of water impinges on a top surface of said at least one tab thereby creating a downward and rearward force on said water, wherein said at least one tab has a variable surface.

26. A control mechanism for a watercraft as recited in claim 25 wherein said variable surface includes a section that is moveable with respect to said at least one tab to allow a volume of water to pass through said at least one tab.

27. A control mechanism for a watercraft as recited in claim 26 wherein said variable section is a pivotal flap that can move from a closed position to an open position.

28. A control mechanism for a watercraft as recited in claim 27 wherein said pivotal flap comprises a resilient member capable of exerting a resilient force, said resilient member adapted to urge said pivotal flap from said open position back to said closed position when a force tending to open said flap is less than said resilient force.

29. A control mechanism for a watercraft as recited in claim 28 wherein said resilient member comprises a rotational spring.

30. A control mechanism for a watercraft as recited in claims 29 wherein said mechanism further comprises a stopper for limiting said at least one tab in its operative position.

31. The control mechanism of claim 25, wherein said at least one tab comprises at least two tabs being activated by said decelerating actuation mechanism, said at least two tabs moveable between an inoperative position and an operative position whereby said at least two tabs can be angled such that, in the operative position, a volume of water impinges on a surface of said at least two tabs thereby creating a downward and rearward force on said watercraft.

32. The control mechanism of claim 31, wherein said at least two tabs are translationally displaceable between said inoperative position and said operative position.

33. The control mechanism of claim 32, wherein said at least two tabs are pivotally displaceable between said operational position and said operative position.

34. The control mechanism of claim 31, wherein said two tabs simultaneously move between the inoperable and operable positions.

35. A control mechanism for a watercraft, said mechanism comprising:

(a) a deceleration actuation mechanism; and (b) at least one tab capable of being activated by said decelerating actuation mechanism, said at least one tab moveable between an inoperative position and an operative position whereby said at least one tab can be angled such that, in the operative position, a volume of water impinges on a top surface of said at least one tab thereby creating a downward and rearward force on said watercraft, wherein a propulsion source defines a propulsion axis and wherein at least two tabs are disposed laterally and substantially equally distant from said propulsion axis to form a substantially symmetrical arrangement.

36. A control mechanism for a watercraft, said mechanism comprising:

(a) a deceleration actuation mechanism; and (b) at least one tab capable of being activated by said decelerating actuation mechanism, said at least one tab moveable between an inoperative position and an operative position whereby said at least one tab can be angled such that, in the operative position, a volume of water impinges on a top surface of said at least one tab thereby creating a downward and rearward force on said watercraft, wherein said at least one tab is hooked.

37. A control mechanism for a watercraft, said mechanism comprising:

(a) a steerable propulsion source;

(b) a steering controller for controlling said steerable propulsion source;

(c) a linking member connected to said steerable propulsion source;

(d) at least one tab connected to said linking member, said tab moveable between an inoperative position and a plurality of operative positions whereby said at least one tab can be angled such that, in the operative positions and when said watercraft is traveling upright in water in a substantially forward direction, a volume of water impinges on a top surface of said at least one tab thereby creating a downward and rearward force on said watercraft.

38. A control mechanism for a watercraft as recited in claim 37 wherein said at least one tab is translationally displaceable between said inoperative position and said operative position.

39. A control mechanism for a watercraft as recited in claim 37 wherein said at least one tab is pivotally displaceable between said inoperative position and said operative position.

40. A control mechanism for a watercraft as recited in claim 37 wherein said at least one tab has a variable surface.

41. A control mechanism for a watercraft as recited in claim 40 wherein said variable surface includes a section that is moveable with respect to said at least one tab to allow a volume of water to pass through said at least one tab.

42. A control mechanism for a watercraft as recited in claim 41 wherein said variable section is a pivotal flap that can move from a closed position to an open position.

43. A control mechanism for a watercraft as recited in claim 42 wherein said pivotal flap comprises a resilient member capable of exerting a resilient force, said resilient member adapted to urge said pivotal flap from said open position back to said closed position when a force tending to open said flap is less than said resilient force.

44. A control mechanism for a watercraft as recited in claim 43 wherein said resilient member comprises a rotational spring.

45. A control mechanism for a watercraft as recited in claim 37 wherein said mechanism further comprises a stopper for limiting said at least one tab in its operative position.

46. A control mechanism for a watercraft as recited in claim 37 wherein said propulsion source defines a propulsion axis and wherein at least two tabs are disposed laterally and substantially equally distant from said propulsion axis to form a substantially symmetrical arrangement.

47. A control mechanism for a watercraft as recited in claim 37 wherein said at least one tab is hooked.

48. A control mechanism for a watercraft as recited in claim 37 wherein said at least one tab is mounted at a stern portion of said watercraft.

49. A control mechanism for a watercraft comprising at least one tab provided with a variable surface, wherein said variable surface includes a moveable section to allow a volume of water to pass through said at least one tab.

50. A control mechanism for a watercraft as recited in claim 49 wherein said variable section is a pivotal flap that can move from a closed position to an open position.

51. A control mechanism for a watercraft as recited in claim 50 wherein said pivotal flap comprises a resilient member capable of exerting a resilient force, said resilient member adapted to urge said pivotal flap from said open position back to said closed position when a force tending to open said at least one flap is less than said resilient force.

52. A control mechanism for a watercraft as recited in claim 51 wherein said resilient member comprises a rotational spring.

53. A control mechanism for a watercraft as recited in claim 52 wherein said mechanism further comprises a stopper for limiting said at least one tab in its operative position.

54. A control mechanism for a watercraft as recited in claim 53, said mechanism being usable for steering said watercraft.

55. A control mechanism for a watercraft as recited in claim 54, said mechanism being usable for trimming said watercraft.

56. A control mechanism for a watercraft as recited in claim 55, said mechanism being usable for slowing said watercraft.

57. A control mechanism for a watercraft, said control mechanism comprising:

(a) at least two tabs each having:

a leading edge; and a trailing edge;

(b) an actuator connected to said at least two tabs, said actuator capable of manipulating said at least two tabs between an inoperative position and an operative position whereby said at least two tabs can be angled such that, in the operative position, a volume of water impinges on a top surface of said at least two tabs thereby creating a downward and rearward force on said watercraft wherein each said tab can be actuated either (i) asymmetrically, to produce an asymmetrical force for steering said watercraft; or (ii) symmetrically, to produce a symmetrical force in a direction substantially opposite to the direction of travel of said watercraft, said control mechanism further comprising a steerable propulsion source linked to said actuators whereby turning of said steerable propulsion source actuates at least one of said tabs.

58. A control mechanism for a watercraft as recited in claim 57 wherein said tabs further comprise resiliently-biased flaps, said flaps having resilient members such that at high speeds a momentum of water impinging on said flaps forces open said flaps when said momentum exceeds a force generated by said resilient member.

59. A control mechanism for a watercraft as recited in claim 58 further comprising stoppers capable of limiting the motion of said tabs when the said leading edge is inclined into the water.

60. A control mechanism for a watercraft as recited in claim 59 wherein said tabs further comprise a plurality of holes.

61. A control mechanism for a watercraft as recited in claim 60 further comprising a lock stopper mechanism capable of preventing said tabs from opening accidentally at high speeds.

62. The control mechanism of claim 57, wherein each of said at least two tabs further having a pivoting point, and said actuator manipulating said at least two tabs further comprises said actuator being capable of pivoting said at least two tabs about said pivoting point.

63. A control mechanism kit for a watercraft, said kit comprising:

a linking member connectable to a steerable propulsion source;

at least one tab connectable to said linking member, said at least one tab moveable between an inoperative position and an operative position whereby said at least one tab can be angled such that, in the operative position and when said watercraft is traveling upright in water in a substantially forward direction, a volume of water impinges on a top surface of said at least one tab thereby creating a downward and rearward force on said watercraft.

64. A control mechanism kit for a watercraft as recited in claim 63 wherein said kit is a retrofit kit.

65. A control mechanism kit for a watercraft as recited in claim 64 wherein said at least one tab is pivotally displaceable between said inoperative position and said operative position.

66. A control mechanism kit for a watercraft as recited in claim 65 wherein said variable surface includes a section that is moveable with respect to said at least one tab to allow a volume of water to pass through said at least one tab.

67. A control mechanism kit for a watercraft as recited in claim 66 wherein said pivotal flap comprises a resilient member capable of exerting a resilient force, said resilient member adapted to urge said pivotal flap from said open position back to said closed position when a force tending to open said flap is less than said resilient force.

68. A control mechanism kit for a watercraft as recited in claim 67 wherein said mechanism further comprises a stopper for limiting said at least one tab in its operative position.

69. A control mechanism kit for a watercraft as recited in claim 63 wherein said at least one tab is translationally displaceable between said inoperative position and said operative position.

70. A control mechanism kit for a watercraft as recited in claim 69 wherein said at least one tab has a variable surface.

71. A control mechanism kit for a watercraft as recited in claim 70 wherein said variable section is a pivotal flap that can move from a closed position to an open position.

72. A control mechanism kit for a watercraft as recited in claim 71 wherein said resilient member comprises a rotation spring.

73. A watercraft control mechanism comprising:

(A) a steerable propulsion source;

(B) a starboard actuating linkage connected to said steerable propulsion source;

(C) a port actuating linkage connected to said steerable propulsion source;

(D) a starboard tab connected to said starboard actuating linkage;

(E) a port tab connected to said port actuating linkage;

(F) a ride plate to which said starboard tab and said port tab are hingedly connected whereby turning of the steerable propulsion source to starboard causes said starboard tab to pivot below said ride plate thereby drag-steering to starboard and whereby turning of the steerable propulsion source to port causes said port tab to pivot below said ride plate thereby drag-steering to port; and (G) a deceleration actuation linkage capable of causing said starboard tab and said port tab to pivot symmetrically below said ride plate thereby creating a force opposite a direction of travel of the watercraft.

74. A watercraft control mechanism as recited in claim 73 further comprising:

(A) a port spring connected to said port tab, said port spring capable of urging said port tab back to a position flush with said ride plate; and (B) a starboard spring connected to said starboard tab, said starboard spring capable of urging said starboard tab back to a position flush with said ride plate.

75. A watercraft control mechanism as recited in claim 74 wherein said steerable propulsion source includes a steerable nozzle.

76. A watercraft control mechanism as recited in claim 75 wherein said starboard actuating linkage includes a slider-slot capable of providing non-proportional actuation of said starboard tab and wherein said port actuating linkage includes a slider-slot capable of providing non-proportional actuation of said port tab.

77. A watercraft control mechanism as recited in claim 76 wherein said starboard tab and said port tab include a plurality of holes.

78. A watercraft control mechanism as recited in claim 77 wherein said starboard tab and said port tab each include a spring and a spring-loaded flap, said spring-loaded flap capable of pivoting open at high speeds when the momentum of the water impinging on the exposed portion of said spring-loaded flap exceeds the resistance of said spring, thereby alleviating stresses in said watercraft control mechanism and thereby providing smoother, less drastic deceleration at high speeds.

79. A watercraft control mechanism as recited in claim 78 wherein said spring is a torsional spring.

80. A watercraft control mechanism as recited in claim 79 wherein said starboard actuating linkage further includes a starboard nozzle arm and wherein said port actuating linkage further includes a port nozzle arm.

81. A watercraft control mechanism as recited in claim 80 wherein said starboard nozzle arm and said port nozzle arm each include a slot suitable for non-proportional actuation of said starboard tab and said port tab.

82. A watercraft control mechanism as recited in claim 81 wherein said starboard actuating linkage further includes a telescopic slider suitable for non-proportional actuation of said starboard tab and said port actuating linkage further includes a telescopic slider suitable for non-proportional actuation of said port tab.

83. A watercraft control mechanism as recited in claim 82 wherein said starboard actuating linkage further includes a spherical rod-end bearing and wherein said port actuating linkage further includes a spherical rod-end bearing.

84. A watercraft control mechanism as recited in claim 83 further comprising a push-pull steering cable connected to said starboard nozzle arm.

85. A watercraft control mechanism as recited in claim 84 further comprising a push-pull steering cable connected to said port nozzle arm.

86. A watercraft control mechanism as recited in claim 85 further comprising a pull-only steering cable connected to said starboard nozzle arm and a second pull-only steering cable connected to said port nozzle arm.

87. A watercraft control mechanism as recited in claim 86 further comprising a pneumatic or hydraulic damper for smoother actuation of said starboard tab and said port tab.

88. A watercraft control mechanism as recited in claim 87 wherein said starboard tab and said port tab are hooked.

89. A control mechanism for a watercraft, said mechanism comprising:

(a) a deceleration actuation mechanism; and (b) at least one tab having a variable surface and capable of being activated by said decelerating actuation mechanism, said at least one tab moveable between an inoperative position and an operative position whereby said at least one tab can be angled such that, in the operative position and when said watercraft is traveling upright in water in a substantially forward direction, a volume of water impinges on a top surface of said at least one tab thereby creating a downward and rearward force on said watercraft, wherein said variable surface includes a section that is moveable with respect to said at least one tab to allow a volume of water to pass through said at least one tab.

90. A control mechanism for a watercraft as recited in claim 89, wherein said variable section is a pivotal flap that can move from a closed position to an open position.

91. A control mechanism for a watercraft as recited in claim 90, wherein said pivotal flap comprises a resilient member capable of exerting a resilient force, said resilient member adapted to urge said pivotal flap from said open position back to said closed position when a force tending to open said flap is less than said resilient force.

92. A control mechanism for a watercraft as recited in claim 91, wherein said resilient member comprises a rotational spring.

93. A control mechanism for a watercraft as recited in claim 92, wherein said mechanism further comprises a stopper for limiting said at least one tab in its operative position.

94. A control mechanism for a watercraft, and mechanism comprising:

(a) a decelerating actuation mechanism; and (b) at least one hooked tab capable of being activated by said decelerating actuation mechanism, said at least one tab moveable between an inoperative position and an operative position whereby said at least one tab can be angled such that, in the operative position and when said watercraft is traveling upright in water in a substantially forward direction, a volume of water impinges on a top surface of said at least one tab thereby creating a downward and rearward force on said watercraft.

95. A control mechanism for a watercraft, said control mechanism comprising:

(a) at least two tabs, each having a leading edge, a trailing edge, and a pivoting point;

(b) an actuator pivotally connected to said at least two tabs, said actuator capable of pivoting said at least two tabs about said pivoting point, said at least two tabs moveable between an inoperative position and an operative position whereby said at least two tabs can be angled such that, in the operative position and when said watercraft is traveling upright in water in a substantially forward direction, a volume of water impinges on a top surface of said at least two tabs thereby creating a downward and rearward force on said watercraft, wherein each of said at least two tabs can be actuated either asymmetrically, to produce an asymmetrical force for steering said watercraft, or symmetrically, to produce a symmetrical force in a direction substantially opposite to the direction of travel of said watercraft; and (c) a steerable propulsion source linked to said actuators whereby turning of said steerable propulsion source actuates at least one of said at least two tabs.

96. A control mechanism for a watercraft as recited in claim 95, wherein each of said at least two tabs further comprises resiliently-biased flaps, said flaps having resilient members such that at high speeds a momentum of water impinging on said flaps forces open said flaps when said momentum exceeds a force generated by said resilient member.

97. A control mechanism for a watercraft as recited in claim 96, said control mechanism further comprising stoppers capable of limiting the motion of said at least two tabs when said leading edge is inclined into the water.

98. A control mechanism for a watercraft as recited in claim 97, wherein said at least two tabs further comprise a plurality of holes.

99. A control mechanism for a watercraft as recited in claim 98, said control mechanism further comprising a lock stopper mechanism capable of preventing said tabs from opening accidentally at high speeds.

100. A control mechanism for a watercraft comprising at least one tab provided with a variable surface including a section that is moveable with respect to said at least one tab to allow a volume of water to pass through said at least one tab.

101. A control mechanism for a watercraft, said control mechanism comprising:

(a) a plurality of steering tabs;

(b) at least one deceleration tab;

(c) a steering actuator connected to said plurality of steering tabs, said plurality of steering tabs moveable by said steering actuator between an inoperative position and an operative position whereby said plurality of steering tabs can be angled such that, in an operative position, a volume of water impinges on a surface of said plurality of steering tabs thereby creating a downward and rearward force on said watercraft; and (d) a deceleration actuator connected to said at least one deceleration tab wherein said deceleration tab is moveable by said deceleration actuator between in inoperative position and an operative position.

* * * * *